US005298946A

United States Patent [19]

Haneda et al.

[11] Patent Number: 5,298,946

[45] Date of Patent: Mar. 29, 1994

[54] COLOR IMAGE FORMING APPARATUS WITH REMOVABLE CARTRIDGE AND EXPOSURE THROUGH SHEET PATH

[75] Inventors: Satoshi Haneda; Shizuo Morita; Masakazu Fukuchi; Hideo Satoh, all of Tokyo, Japan

[73] Assignee: Konica Corporation, Japan

[21] Appl. No.: 983,967

[22] Filed: Dec. 1, 1992

[30] Foreign Application Priority Data

| | | | |
|---|---|---|---|
| Dec. 3, 1991 | [JP] | Japan | 3-319408 |
| Dec. 9, 1991 | [JP] | Japan | 3-324766 |
| Dec. 26, 1991 | [JP] | Japan | 3-345201 |
| Dec. 26, 1991 | [JP] | Japan | 3-345202 |

[51] Int. Cl.[5] ..... G03G 15/00

[52] U.S. Cl. ..... 355/210; 355/308; 355/326 R

[58] Field of Search ..... 355/232, 233, 309, 326, 355/327, 328, 210, 308; 346/157

[56] References Cited

U.S. PATENT DOCUMENTS 3,960,445 6/1976 Drawe ..... 355/326

FOREIGN PATENT DOCUMENTS 56-161561 12/1981 Japan ..... 355/232
2-157870 6/1990 Japan ..... 355/326
3-39764 2/1991 Japan ..... 355/326

*Primary Examiner*—Joan H. Pendegrass
*Attorney, Agent, or Firm*—Jordan B. Bierman

[57] ABSTRACT

In an apparatus for forming a color toner image, a photoreceptor is disposed at one side of a sheet passage so that a transfer sheet is conveyed through the sheet passage and is brought in contact with the photoreceptor on a transfer station and an exposure device is disposed at the other side of the sheet passage so that an image light irradiated from the exposure device crosses the sheet passage and proceeds to the photoreceptor.

17 Claims, 23 Drawing Sheets

COLOR IMAGE FORMING APPARATUS WITH REMOVABLE CARTRIDGE AND EXPOSURE THROUGH SHEET PATH

BACKGROUND OF THE INVENTION

The present invention relates to a color image forming apparatus in which a plurality of developing units are disposed around the circumferential surface of an image forming body.

Both a drum-shaped image forming body and a belt-shaped image forming body are used for the image forming apparatus. In the case where the former image forming body is adopted, the profile is fixed. On the other hand, in the case where the latter image forming body is adopted, the profile is variable, so that the degree of freedom can be increased when the apparatus is designed.

When the belt-shaped image forming body is adopted, it is possible to provide a wide flat portion of the belt-shaped image forming body, which is advantageous to dispose a plurality of developing units. Therefore, the belt-shaped image forming body is widely used for color image forming apparatus.

When an image forming apparatus is designed, either a drum-shaped image forming body or a belt-shaped image forming body is selected from the viewpoint of the layout of the apparatus. When the belt-shaped image forming body is adopted, it is provided to the apparatus either longitudinally or laterally. In this case, a group of developing units and a cleaning unit are provided in the periphery of the belt-shaped image forming body. Therefore, when they are integrated into a process cartridge, the dimensions of the process cartridge are increased, so that it is difficult to attach the process cartridge to the apparatus or detach it from the apparatus.

When the aforementioned large-scale cartridge is attached to or detached from the apparatus, toner or dust adhered to the cartridge drops on the optical image exposure system, so that there is a possibility that the performance of the optical system is lowered.

The aforementioned problems are solved by the apparatus of the present invention. The first object of the present invention is to provide a color image forming apparatus characterized in that: a jam clearance operation is easily carried out; the process cartridge is easily attached to and detached from the apparatus; and toner leakage can be prevented so that the optical image exposure system is kept clean.

In a color image forming apparatus, image processing is carried out with regard to a plurality of colors. Therefore, the color image forming apparatus includes: a plurality of developing units, each of which has the function of developing a single color, that are provided around the peripheral portion of the image forming body; and a plurality of toner containers that supply toner to the developing units.

On the other hand, since the maintenance operations must be frequently conducted on the developing units, the developing units are integrated into a process cartridge together with the image forming body and the cleaning unit. Consequently, each time the cartridge is attached to and detached from the apparatus, the developing units must be connected with and disconnected from the toner containers.

In order to prevent toner leakage, the structure of the connecting section between the developing unit and the toner container is complicated, so that it is difficult to handle the developing units. Further, when the developing units are disconnected from the toner containers, toner leakage can not be avoided. Therefore, the inside of the apparatus is stained with toner, and the quality of formed images is deteriorated.

In order to solve the aforementioned problems, a countermeasure is taken in which the toner containers and developing units are integrated into one unit and the unit is installed in the process cartridge. However, the aforementioned countermeasure is disadvantageous in that: the dimensions of the process cartridge are increased; and the cartridge must be taken outside each time toner is supplied, and therefore the working efficiency can not be improved.

The aforementioned problems are solved by the present invention. The second object of the present invention is to provide a color image forming apparatus in which a complicated connection mechanism for toner supply is not required and toner can be supplied very easily, for example, toner can be supplied when the process cartridge is moved a little.

SUMMARY OF THE INVENTION

The first object of the present invention can be accomplished by a color image forming apparatus in which a color toner image is formed when charging, image exposure and developing operations are repeatedly conducted on the image forming body and the formed color toner image is transferred onto a transfer sheet, wherein the image forming body is disposed on one side of a sheet feed passage of the transfer sheet, and the image exposure system is disposed on the other of the sheet feed passage.

The aforementioned first object of the invention can be accomplished by a color image forming apparatus including: a belt-shaped image forming body that is provided horizontally; and a process cartridge having a plurality of developing units disposed around the belt-shaped image forming body, the process cartridge being detachably provided to the apparatus, wherein the developing units and a cleaning unit are located under the belt-shaped image forming body, and image exposure is carried out between the belt-shaped image forming body and a charger disposed on the side of the belt-shaped image forming body, the charger being used as a transfer means.

The aforementioned first object of the invention can be accomplished by a color image forming apparatus including: a belt-shaped image forming body that is provided horizontally; and a process cartridge having a plurality of developing units disposed around the belt-shaped image forming body, the process cartridge being detachably provided to the apparatus, wherein the developing units and a cleaning unit are located on the belt-shaped image forming body, and image exposure is carried out between the belt-shaped image forming body and a charger disposed on the side of the belt-shaped image forming body, the charger being used as a transfer means.

The aforementioned second object can be accomplished by a color image forming apparatus including: a plurality of developing units disposed in parallel; toner containers accommodating toner to be supplied to the developing units, wherein the toner containers are disposed in parallel making a right angle with the developing units, and toner is supplied to the developing units by a toner circulation conveyance means installed in each toner container.

DETAILED DESCRIPTION OF THE PREFERRED EMBODIMENT

With reference to the attached drawings, an example of the color image forming apparatus of the present invention will be explained as follows.

Figure 1A:
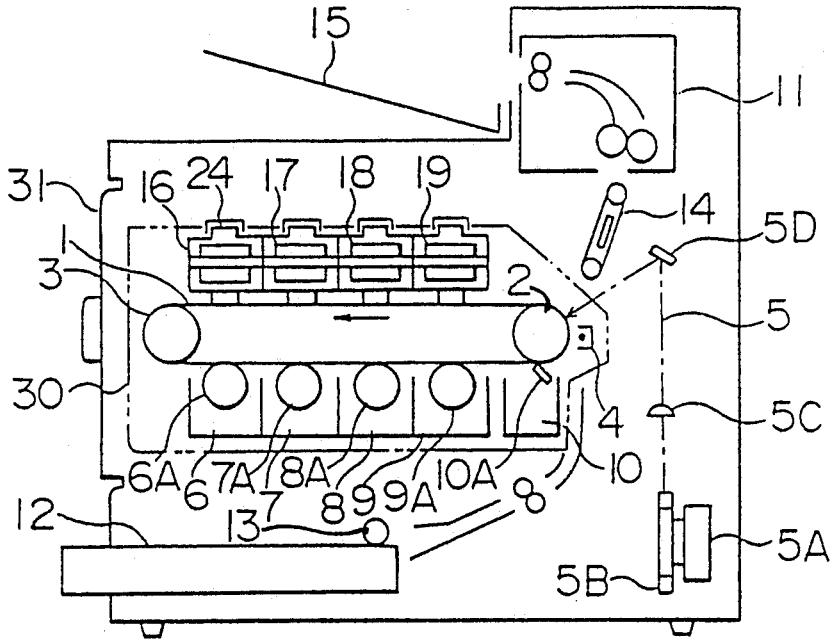
FIGS. 1A and 1B are schematic illustrations showing the structure of the first example of the first embodiment of the color image forming apparatus.

FIG. 1 shows the first example of the first embodiment in which a plurality of developing units are provided below a belt-shaped image forming body. In FIG. 1, numeral 1 is a flexible photoreceptor belt that is a belt-shaped image forming body. The photoreceptor belt 1 is horizontally provided between rotational rollers 2 and 3, and when the rotational roller 2 is driven, the photoreceptor belt 1 is conveyed in the arrowed direction.

Numeral 4 is a charger that is also used as a transfer means, numeral 5 is a laser writing unit, numerals 6 to 9 are developing unit in which a developer of specific color is contained, numeral 10 is a cleaning unit, and numeral 11 is a fixing unit. The developing units 6, 7, 8, 9 are disposed in parallel along the circumferential surface of the photoreceptor belt 1. For example, developers of yellow, magenta, cyan and black are respectively contained in the developing units. The developing units are provided with developing sleeves 6A, 7A, 8A, 9A, and the gaps formed between the photoreceptor belt 1 and the developing sleeves are maintained to be a predetermined value, and a latent image on the photoreceptor belt 1 is visualized by the noncontact reversal developing method. Different from the contact developing method, the noncontact reversal developing method is advantageous in that it does not interfere with the movement of the photoreceptor belt 1.

During the process of image formation, the blade 10A of the cleaning unit 10 is separated from the surface of the photoreceptor belt 1, and only when a cleaning operation is carried out after image formation, the blade 10A comes into pressure contact with the surface of the photoreceptor belt 1 as illustrated in the drawing.

By the color image forming apparatus, color image formation is carried out in the following manner.

In this example, multicolor image formation is carried out according to the following image forming system. That is, an original image is scanned by an image sensor in a color data input section, and the obtained data is processed in an image data processing section so that image data is made. The image data is temporarily stored in an image memory. Then, the image data is taken out from the image memory in the process of recording, and the image data is inputted into a recording section, for example, the image data is inputted into the color image forming apparatus shown in FIG. 1.

A color signal outputted from an image reading apparatus that is different from the aforementioned image forming apparatus, is inputted into the laser writing system unit 5. Then, in the laser writing system unit 5, a laser beam generated by a semiconductor laser (not shown) conducts a rotational scanning operation by the action of a polygonal mirror 5B rotated by a drive motor 5A. The laser beam passes through an $f\theta$ lens 5C, and the optical path of the laser beam is curved by a mirror 5D. Then, the laser beam is projected on the circumferential surface of the photoreceptor belt 1 onto which an electrical charge has been previously given by the charger 4, so that a bright line is formed on the photoreceptor belt 1.

Figure 6:
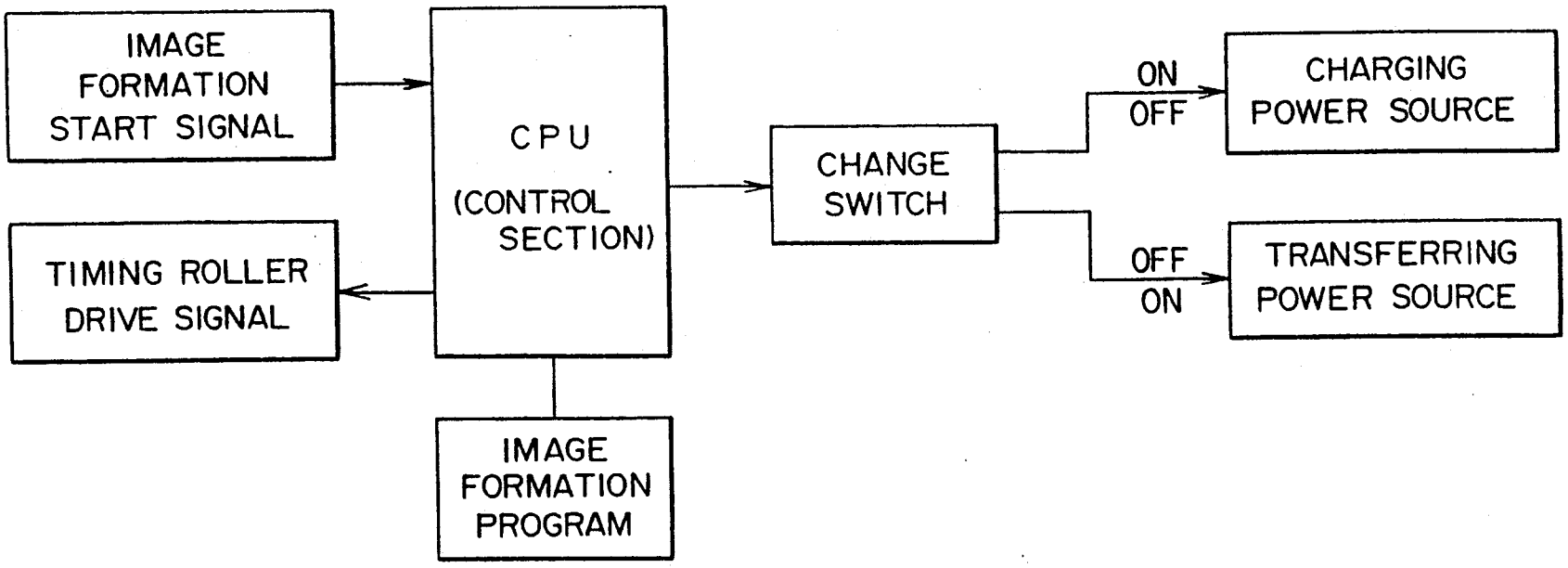
FIG. 6 is a block diagram showing the circuit by which the electric power source of a charger is changed over.

The charger 4 is provided with a charging electrode that is also used as a transfer electrode. As shown in FIG. 6, when an image formation start signal is inputted into a control section by pressing a copy button, a changeover switch is activated, so that the electric power source for charging is turned on and a voltage is impressed upon the photoreceptor belt 1. At this time, the electric power source for transfer is turned off.

On the other hand, when the scanning operation is started, the beam is detected by the index sensor, and the beam modulation is started by the first color signal, so that the modulated beam scans the circumferential surface of the photoreceptor belt 1. Accordingly, a latent image corresponding to the first color is formed on the circumferential surface of the photoreceptor belt 1 by the primary scanning and the auxiliary scanning, wherein the primary scanning is conducted by the laser beam, and the auxiliary scanning is conducted by the conveyance of the photoreceptor belt 1. The formed latent image is reversal-developed by the developing unit 6 loaded with yellow (Y) toner under the noncontact condition, so that a toner image is formed on the belt surface. The toner image on the belt passes under the cleaning unit 10 separated from the circumferential surface of the photoreceptor belt 1. Then, the process advances to the successive copy cycle.

The photoreceptor belt 1 is charged again by the charger 4, and then the second color signal outputted from the signal processing section is inputted into the laser writing system unit 5. In the same manner as the first color signal, a writing operation is conducted on the belt surface, so that a latent image is formed. The formed latent image is reversal-developed by the developing unit 7 loaded with magenta (M) toner under the noncontact condition.

The magenta (M) toner image is formed under the presence of the yellow (Y) toner image that has already been formed.

Numeral 8 is a developing unit loaded with cyan (C) toner. By the developing unit 8, a cyan (C) toner image is formed on the belt surface in accordance with a control signal generated by the signal processing section.

Numeral 9 is a developing unit loaded with black toner. In the same manner as described above, a black toner image formed in registration on the belt surface. A DC and/or an AC bias voltage is impressed upon each developing sleeve of the developing units 6, 7, 8, and a jumping development operation is carried out by one-component or two-component developer so that the image on the photoreceptor belt 1 is reversal-developed under the noncontact condition.

In the manner described above, a color toner image is formed on the circumferential surface of the photoreceptor belt 1 while it is rotated by 4 revolutions. The color toner image is transferred onto a transfer sheet that is sent from the paper feed cassette 12 and conveyed by the timing roller 13.

Synchronously with the drive signal for the timing roller 13 sent from the control section, the electric power source for transfer is switched on, so that a transfer voltage is impressed upon the transfer sheet, and the toner image is transferred onto the transfer sheet from the photoreceptor belt 1. At this time, the electric power source for charging is switched off.

After the toner image has been transferred onto the transfer sheet, the transfer sheet is separated from the circumferential surface of the photoreceptor belt 1 and conveyed by the conveyance belt 14 having the function to attract the transfer sheet. After that, the toner image is fixed by the fixing unit 11, and then the transfer sheet is discharged onto the tray 15.

After the transfer sheet has been separated from the photoreceptor belt 1, the photoreceptor belt 1 starts the fifth revolution in which the blade 10A of the cleaning unit 10 is brought into pressure contact with the photoreceptor belt 1 so that the residual toner is removed and the belt surface is cleaned. Then, the photoreceptor belt 1 is charged again by the charger 4 and enters the successive image forming process.

Numerals 16, 17, 18 and 19 are toner containers, the profile of which is a rectangular parallelpiped, in which toners to be supplied to the developing units 6, 7, 8 and 9 are accommodated. The toner containers are disposed above the photoreceptor belt 1 on the opposite side to the developing units.

Figure 5:
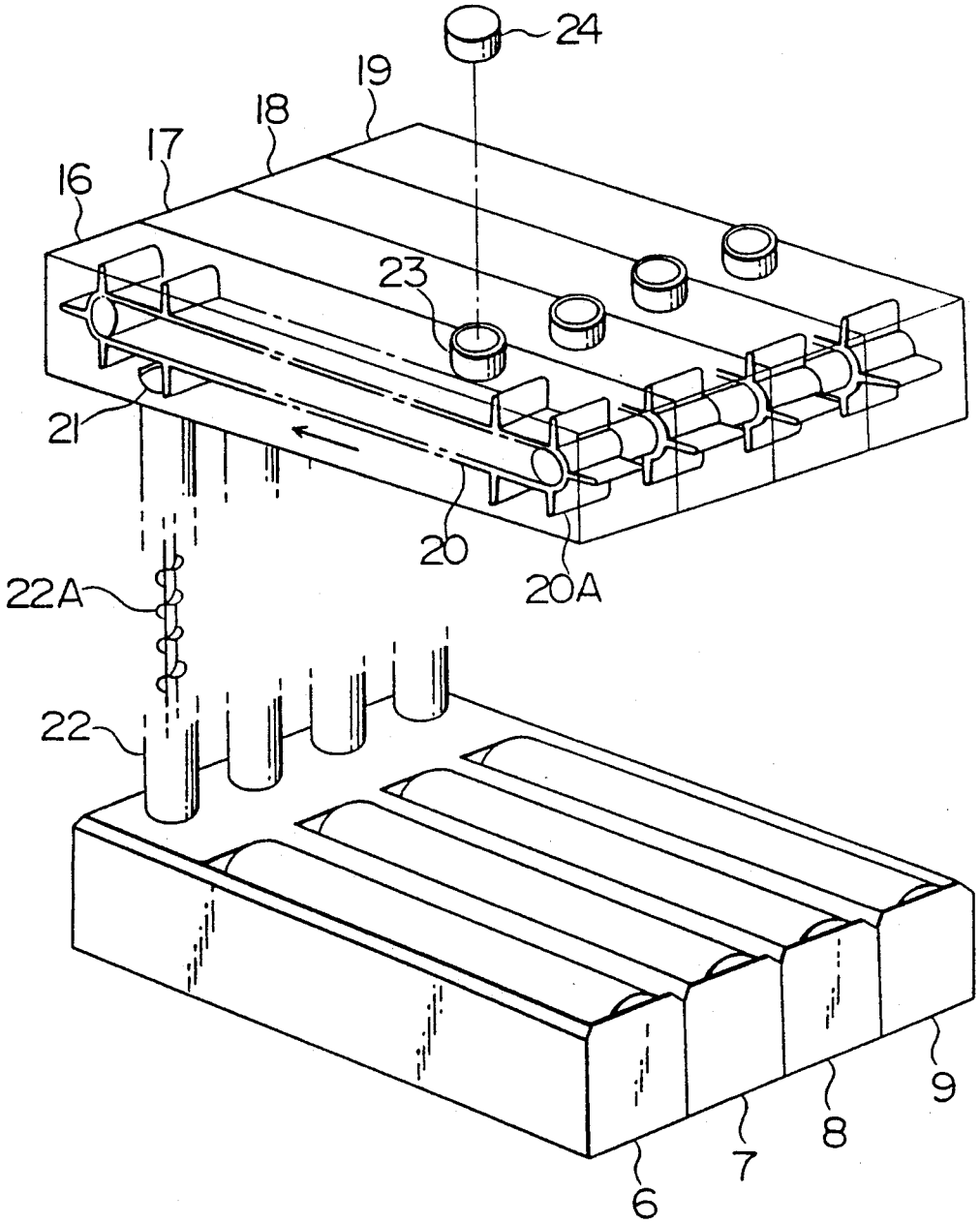
FIG. 5 is a schematic illustration showing the connection between each developing unit and toner container.

Each of the toner containers 16, 17, 18 and 19 is provided with a belt-shaped conveyance member 20 rotated clockwise as shown in FIG. 5.

A plurality of flexible fins are protruded from the outer circumferential surface of the conveyance member 20 so that the accommodated toner can be conveyed in the arrowed direction. The conveyed toner is dropped from a hole 21 on the bottom surface to a pipe 22 connected with the developing unit so that the toner can be supplied. The toner dropped into the pipe 22 is effectively conveyed by the action of a conveyance screw 22A. In this manner, the toner is supplied to the developing unit.

Toner supply ports 23 from which toner is supplied to the toner containers, are disposed in series as shown in FIG. 5. Usually, the toner supply port 23 is covered with a cap 24.

The developing units and toner containers are integrally assembled to the process cartridge 30 (shown by a two-dotted chain line) together with the photoreceptor belt 1, charger 4 and cleaning unit 10.

Figure 1B:
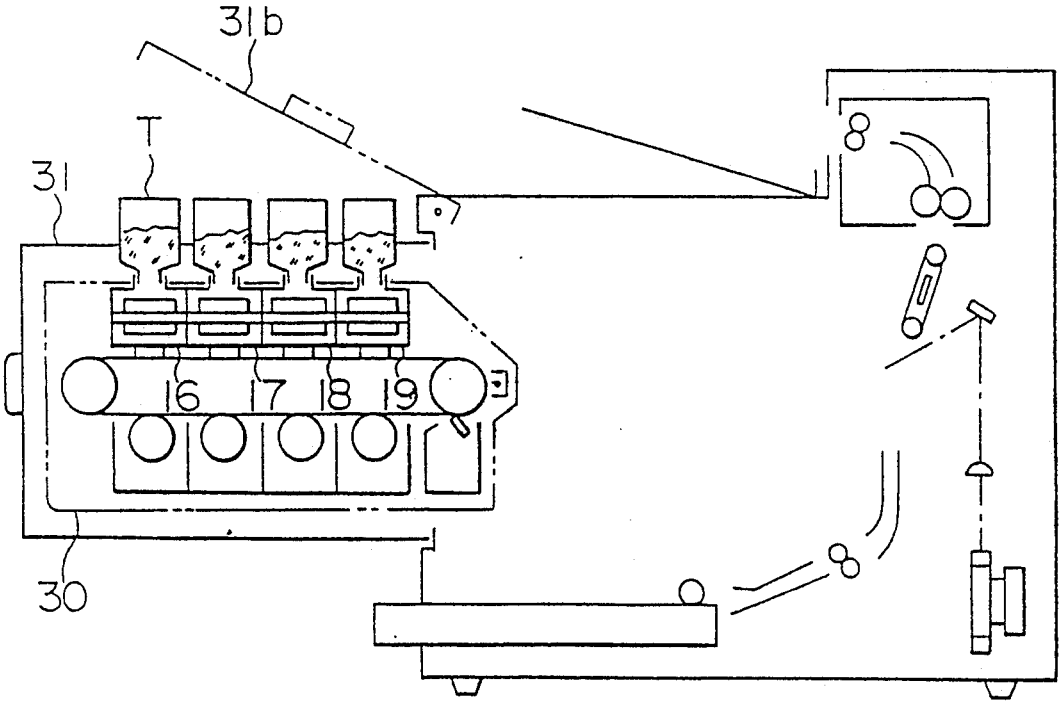

As shown in FIG. 1B, the process cartridge 30 can be moved to the left along a guide rail (not shown) when a cover 31 on the side of the apparatus is open. As shown by a one-dotted chain line, a cover **31*b*** may be provided so as to be opened upward.

Accordingly, only when the process cartridge 30 is pulled out from the apparatus body, it becomes possible to attach toner cartridges T to all the toner containers. Therefore, the toner supply operation can be very easily carried out.

Figure 2:
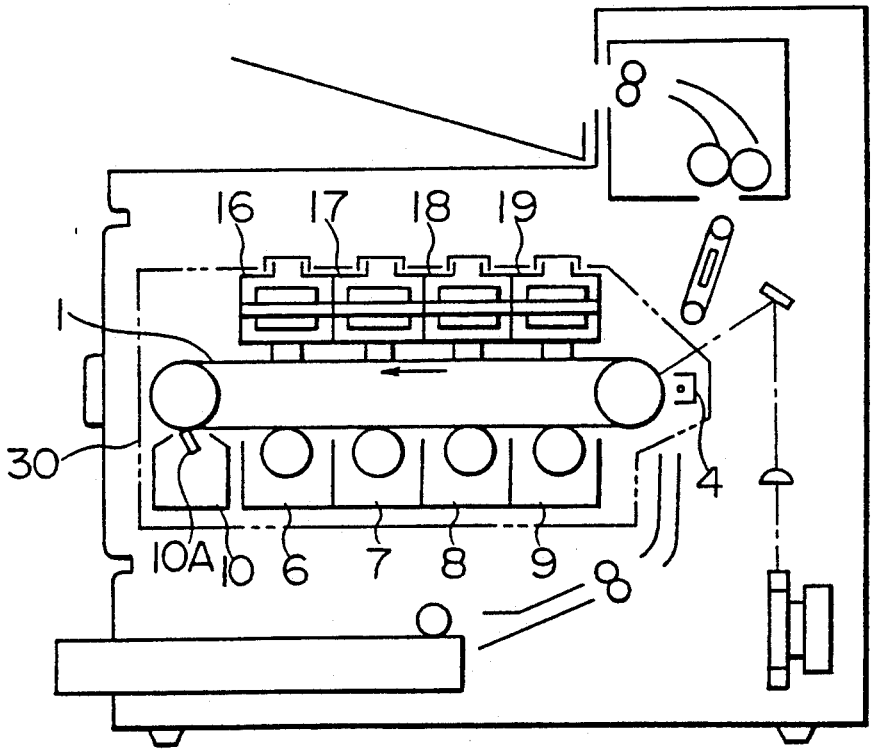
FIG. 2 is a schematic illustration showing the structure of another example of the aforementioned apparatus.

The cleaning unit 10 may be disposed on the upstream side of the developing unit group as shown in FIG. 2. In this case, the image forming process is performed in the same sequence as described before. Therefore, when the photoreceptor belt 1 is rotated by 5 revolutions, one image formation cycle is completed.

Figure 3A:
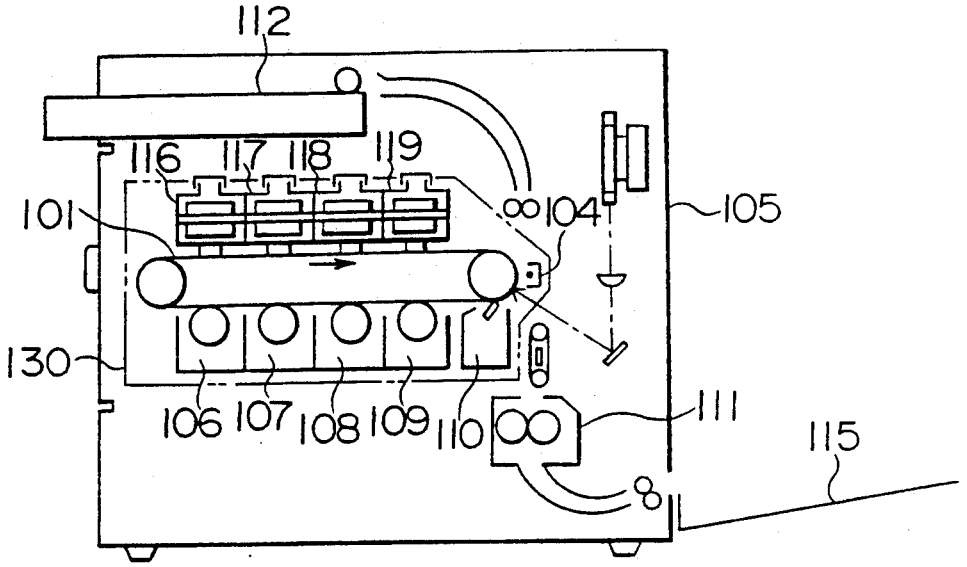
FIGS. 3A and 3B are schematic illustrations showing the structure of the second example of the first embodiment.

FIG. 3A shows the second example of the present invention. The second example is structured in the following manner: transfer sheets are supplied downward from the paper feed cassette 112 mounted on the upper portion of the apparatus; and the transfer sheets are discharged onto the paper discharge tray 115 through the fixing unit 111.

In this example, the photoreceptor belt 1 is conveyed clockwise in the arrowed direction, and the image formation process is carried out in the same sequence as that of the first example, so that one color image formation cycle is completed when the photoreceptor belt 1 is rotated by 5 revolutions.

Figure 3B:
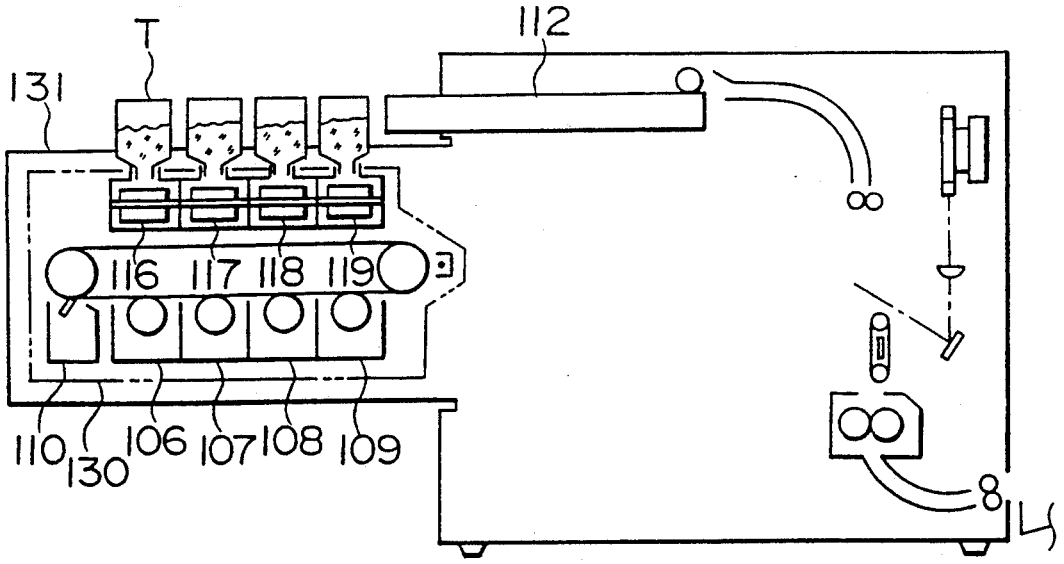

As shown in FIG. 3B, in this example, toner is replenished to the toner containers 116, 117, 118 and 119 when the cover 131 provided on the side of the apparatus is open and the process cartridge 130 is pulled out.

Figure 4:
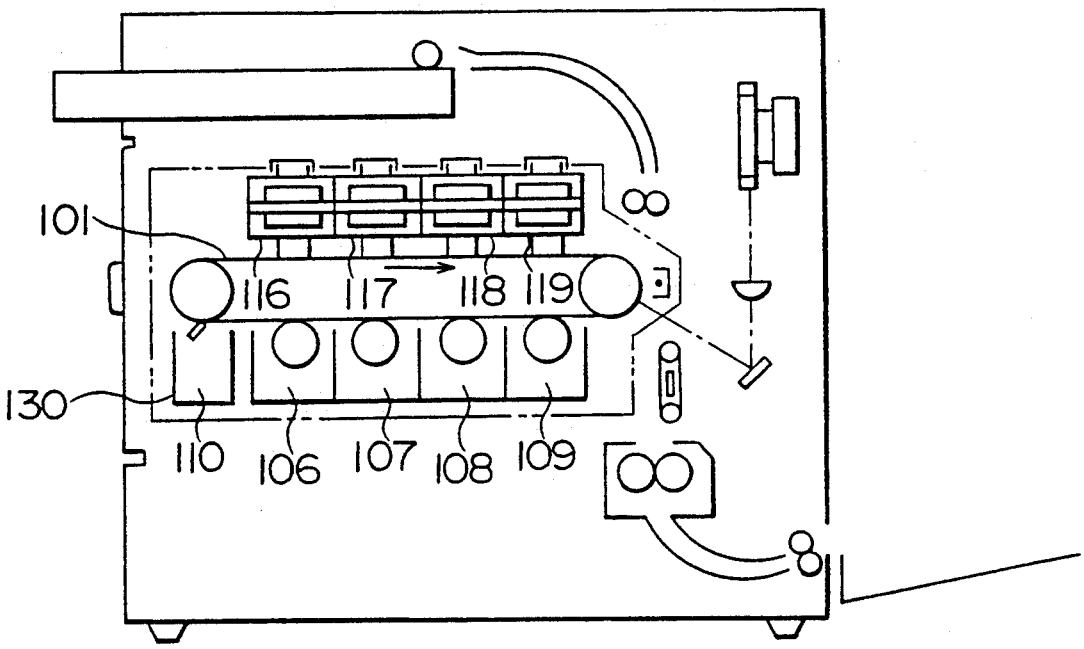
FIG. 4 is a schematic illustration showing another example of the aforementioned apparatus.

FIG. 4 shows an example in which the cleaning unit 110 is disposed downstream of the developing unit group, being adjacent to the developing unit group.

Figure 7A:
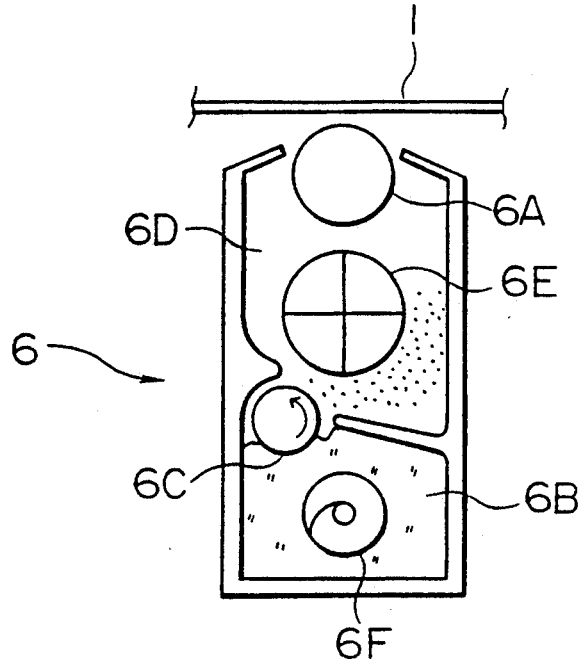
FIGS. 7A and 7B are sectional views showing the developing unit used for the aforementioned apparatus.

In both the first and second examples, in the case where two-component developer is used, the developing unit shown in FIG. 7A is applied. The toner supplied into the developing unit is uniformly distributed in the toner reservoir 6B by the action of the conveyance screw 6F provided in the developing unit 6. After that, when the toner supply roller 6C is rotated in accordance with the decrease in the concentration of toner in the developing tank 6D, the toner is conveyed into the developing tank 6D and mixed with the carrier by the action of the stirring member 6E. The mixture of toner and carrier is supplied to the developing sleeve 6A.

Figure 7B:
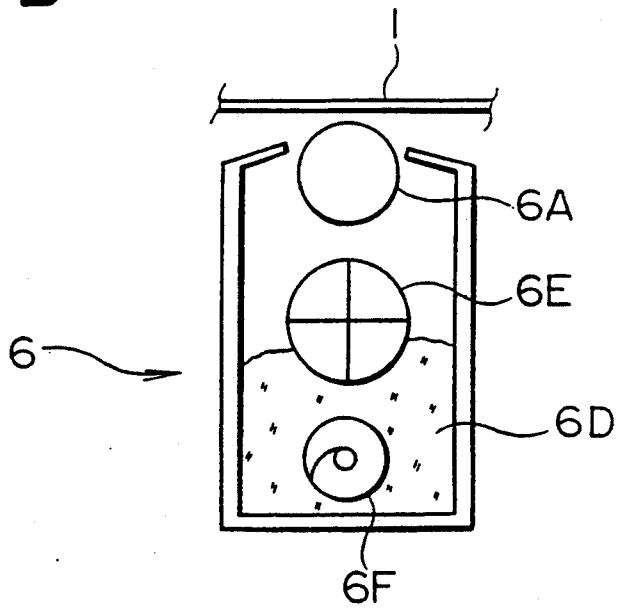

On the other hand, when one-component developer is used, the developing unit shown in FIG. 7B is applied to the apparatus. Toner is directly supplied to the developing tank 6D in accordance with the consumption, and uniformly distributed in the developing tank 6D by the action of the conveyance screw 6F and the stirring member 6E, and then supplied to the developing sleeve 6A.

Figure 8:
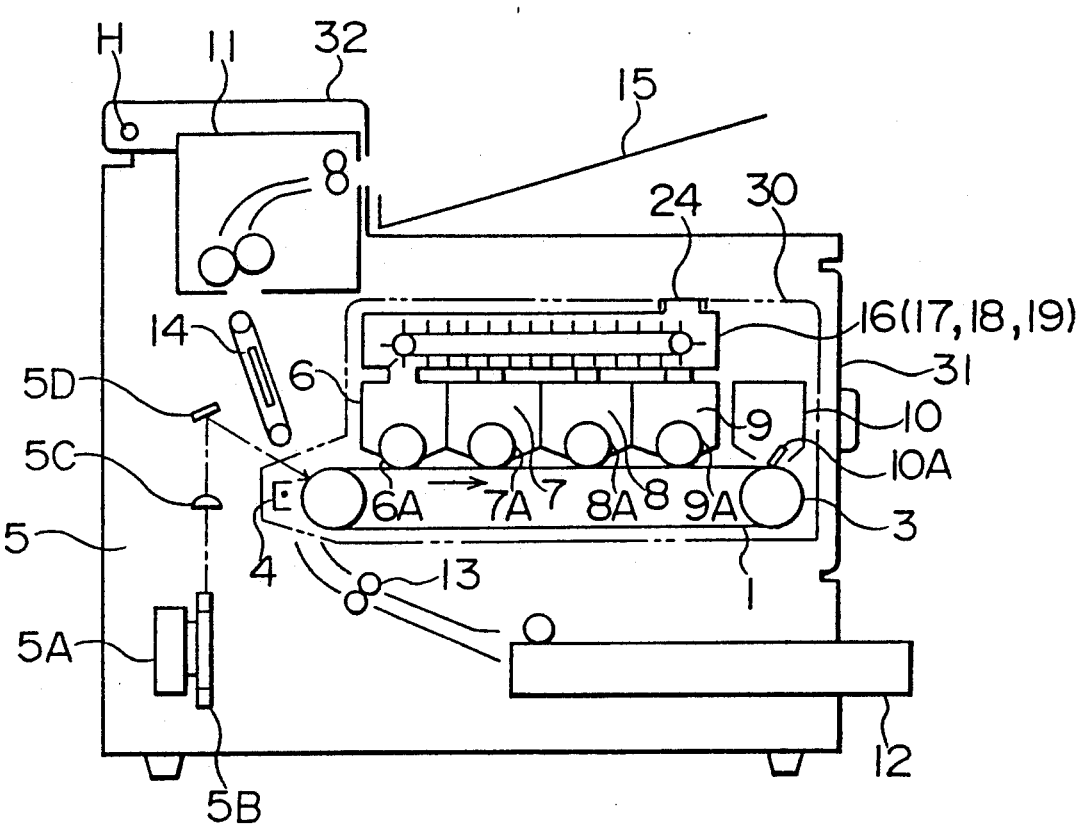
FIG. 8 is a schematic illustration showing the structure of the first example of the second embodiment of the color image forming apparatus.

FIG. 8 shows the first example of the second embodiment in which a plurality of developing units are provided above the belt-shaped image forming body.

In FIG. 8, numeral 16 is a toner container, the profile of which is a rectangular parallelepiped, in which toner to be supplied to the developing units 6 is accommodated, wherein the toner container 16 is integrally connected with the developing unit 6, making a right angle with the developing unit 6.

Each of the toner containers 17, 18 and 19 to supply toner to each of the developing units 7, 8 and 9, is also integrally connected with the developing unit, making a right angle in the same manner as the toner container 16. Accordingly, the toner containers 17, 18 and 19 are disposed in parallel on the back side of the container 16.

Figure 15:
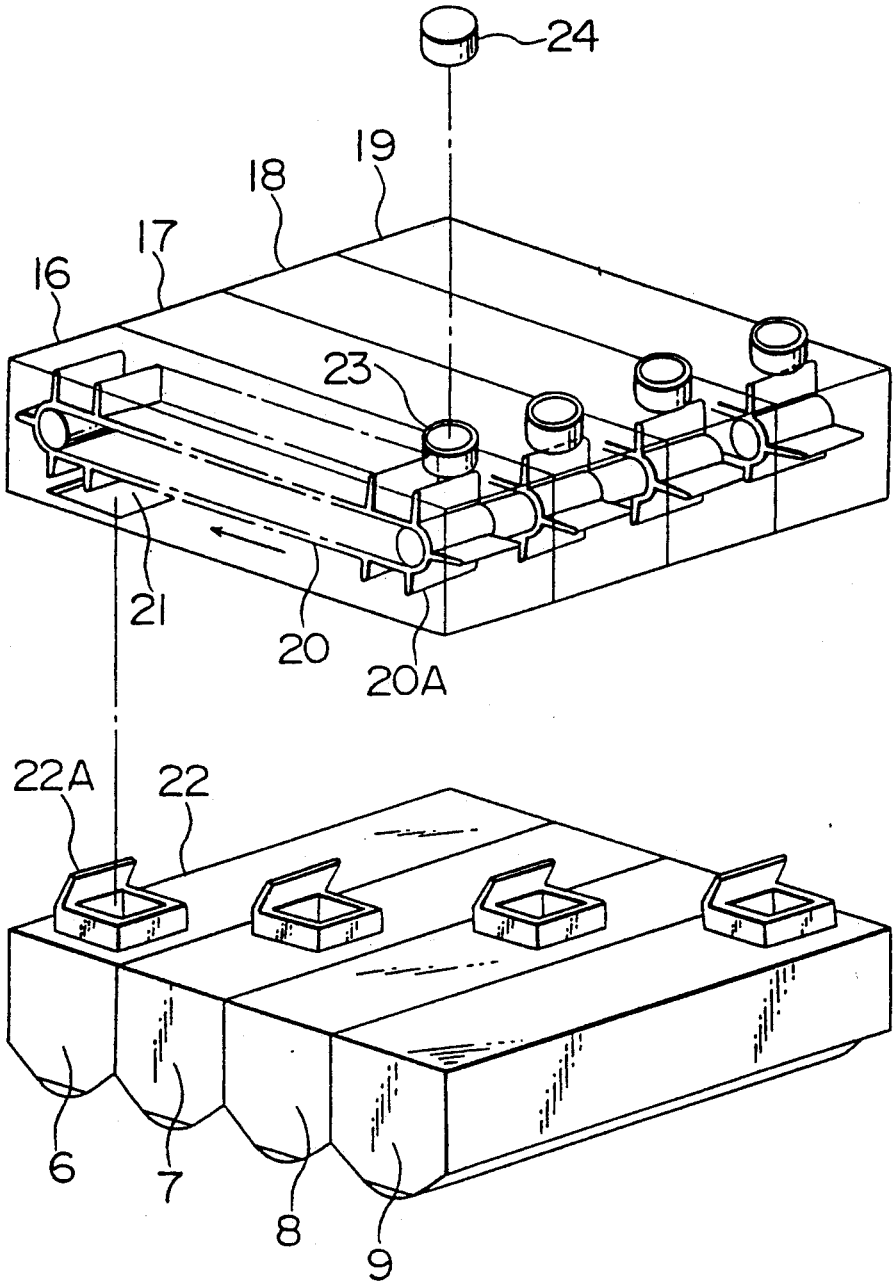
FIG. 15 is a schematic illustration showing the connection between each developing unit and toner container.

Each of the toner containers 16, 17, 18 and 19 is provided with the belt-shaped conveyance member 20 rotated clockwise as shown in FIG. 15, wherein the belt-shaped conveyance member 20 is used as a circulation conveyance means.

A plurality of flexible fins are protruded from the outer circumferential surface of the conveyance member 20 so that the accommodated toner can be conveyed in the arrowed direction. The conveyed toner is dropped from a hole 21 on the bottom surface to a port 22 connected with the developing unit so that the toner can be supplied. At this time, the fin 20A is slidably contacted with the sliding plate 22 mounted on the port 22 so that the conveyed toner can be efficiently dropped to the port 22.

Toner supply ports 23 from which toner is supplied to the toner containers, are disposed in series as shown in FIG. 5. Usually, the toner supply port 23 is covered with a cap 24.

The developing units and toner containers are integrally assembled to the process cartridge 30 (shown by a two-dotted chain line) together with the photoreceptor belt 1, charger 4 and cleaning unit 10.

Figure 9A:
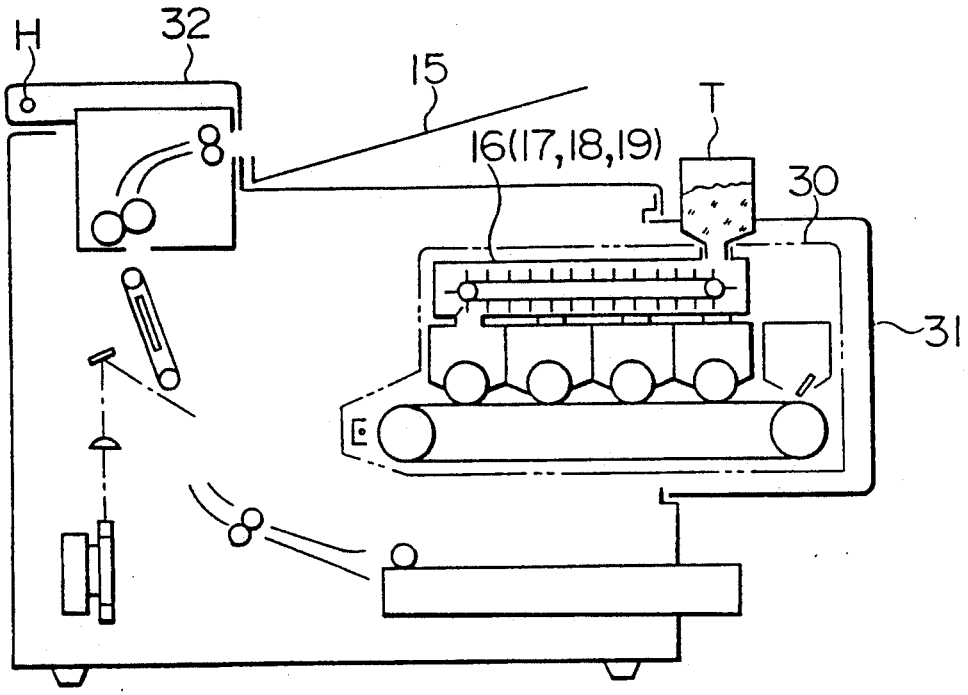
FIGS. 9A and 9B are schematic illustrations showing the state of toner supply of the aforementioned apparatus.

As shown in FIG. 9A, the process cartridge 30 can be moved to the right along a guide rail (not shown) when a cover 31 on the side of the apparatus is open.

Figure 9B:
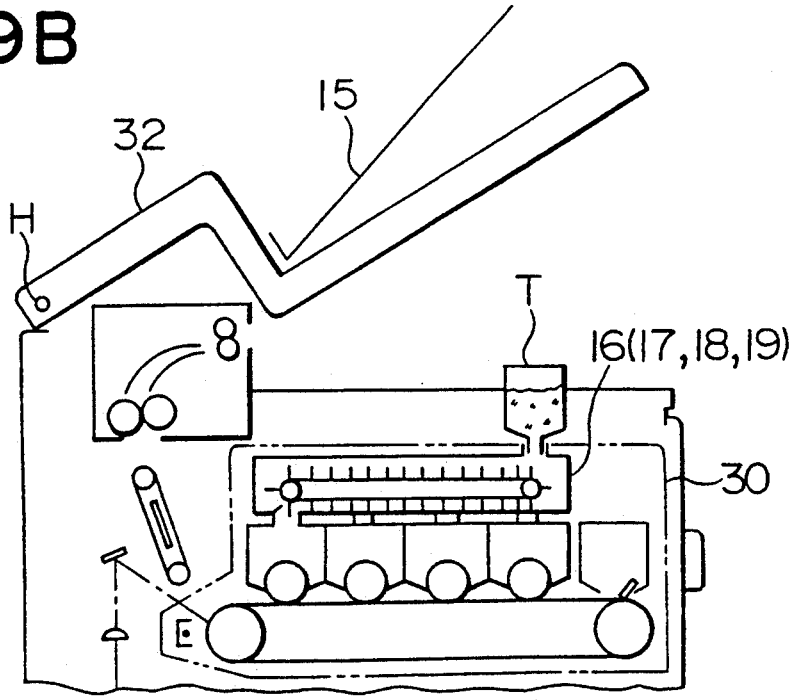

As shown in FIG. 9(*b*), the upper cover 32 of the apparatus may be rotated clockwise around hinge H so that the upper portion of the process cartridge 30 is exposed.

Consequently, in the apparatus of the present invention, when the process cartridge 30 is pulled out a little or the upper cover 32 of the apparatus is open in the case of toner supply, toner cartridges T can be provided to all toner containers. Therefore, the toner replenishing operation can be very easily carried out.

Figure 10:
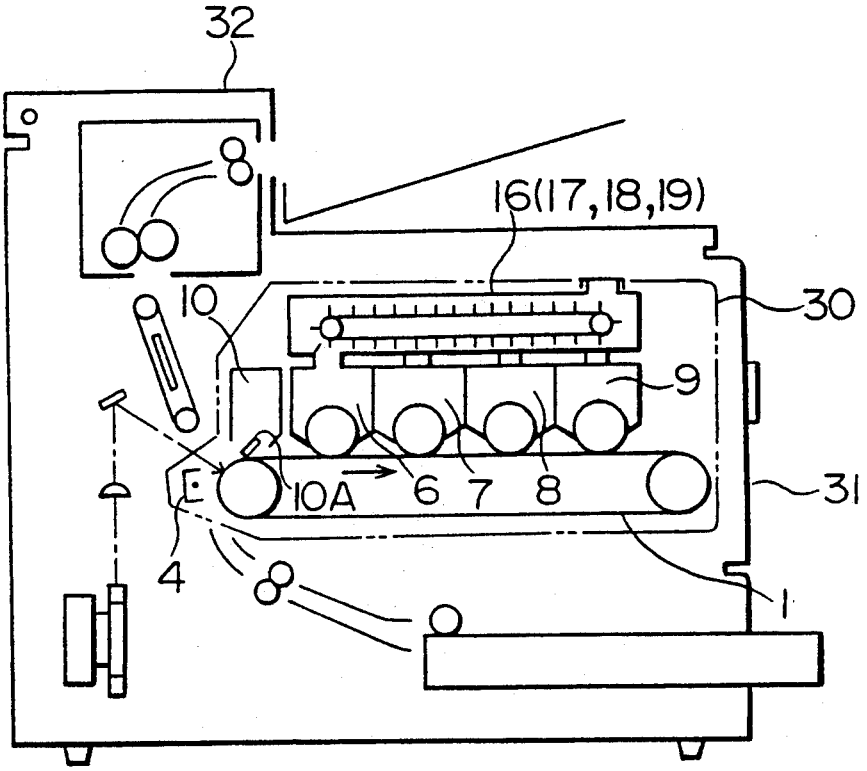
FIG. 10 is a schematic illustration showing the structure of another example of the aforementioned apparatus.

As shown in FIG. 10, the cleaning unit 10 may be disposed on the upstream of the developing unit group while the cleaning unit 10 is adjacent to the developing unit group. In this case, the image formation process is carried out in the same sequence as that described before, and when the photoreceptor belt 1 is rotated by 5 revolutions, one cycle of color image formation is completed.

Figure 11A:
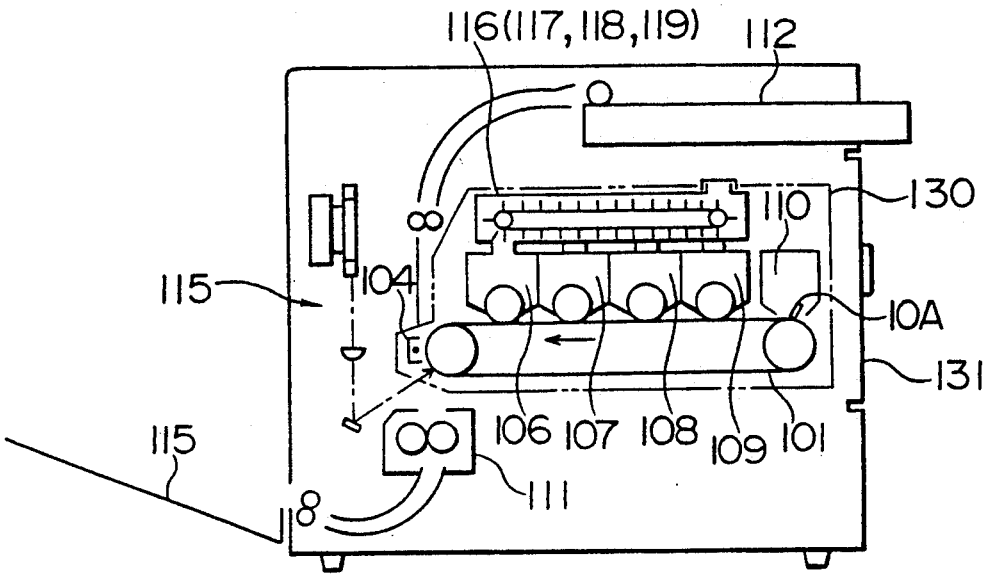
FIGS. 11A an 11B are schematic illustrations showing the structure of the second example of the second embodiment.

FIG. 11 is a schematic illustration showing the second example. The second example is structured in the following manner: transfer sheets are supplied downward from the paper feed cassette 112 mounted on the upper portion of the apparatus; and the transfer sheets are discharged onto the paper discharge tray 115 through the fixing unit 111.

In this example, the photoreceptor belt 101 is conveyed counterclockwise in the arrowed direction, and the image formation process is carried out in the same sequence as that of the first example, so that one color image formation cycle is completed when the photoreceptor belt 101 is rotated by 5 revolutions.

Figure 11B:
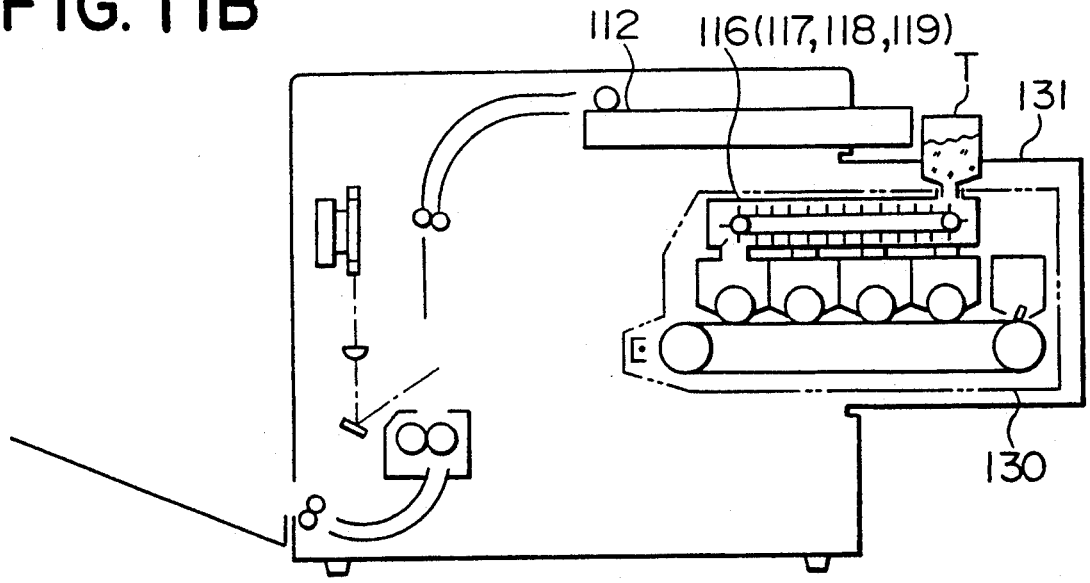

As shown in FIG. 11B, in this example, toner is replenished to the toner containers 116, 117, 118 and 119 when the cover 131 is open and the process cartridge 130 is pulled out a little.

Figure 12:
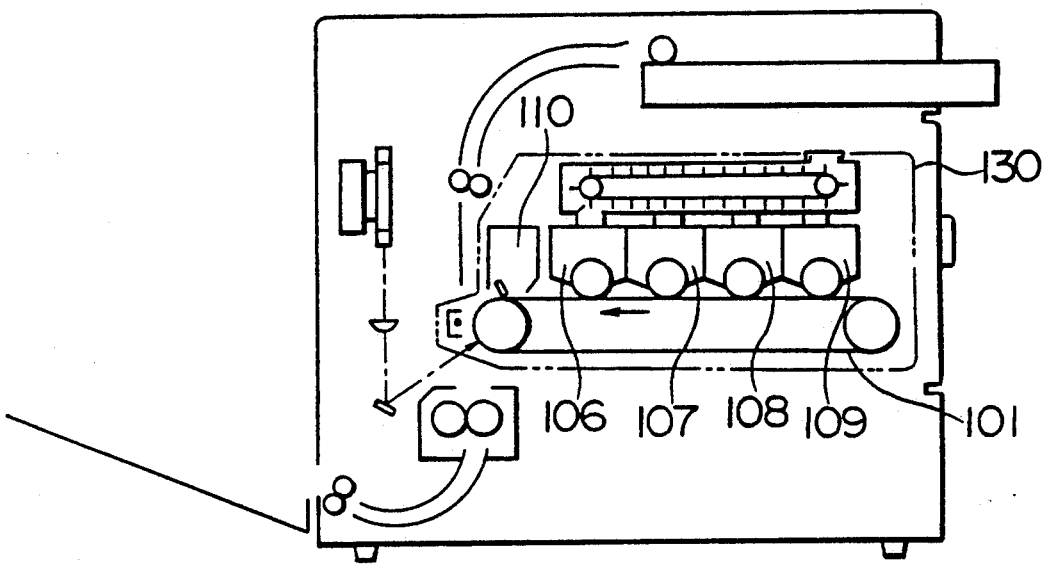
FIG. 12 is a schematic illustration showing the structure of another example of the aforementioned apparatus.

FIG. 12 shows an example in which the cleaning unit 110 is disposed downstream of the developing unit group, being adjacent to the developing unit group.

Figure 13:
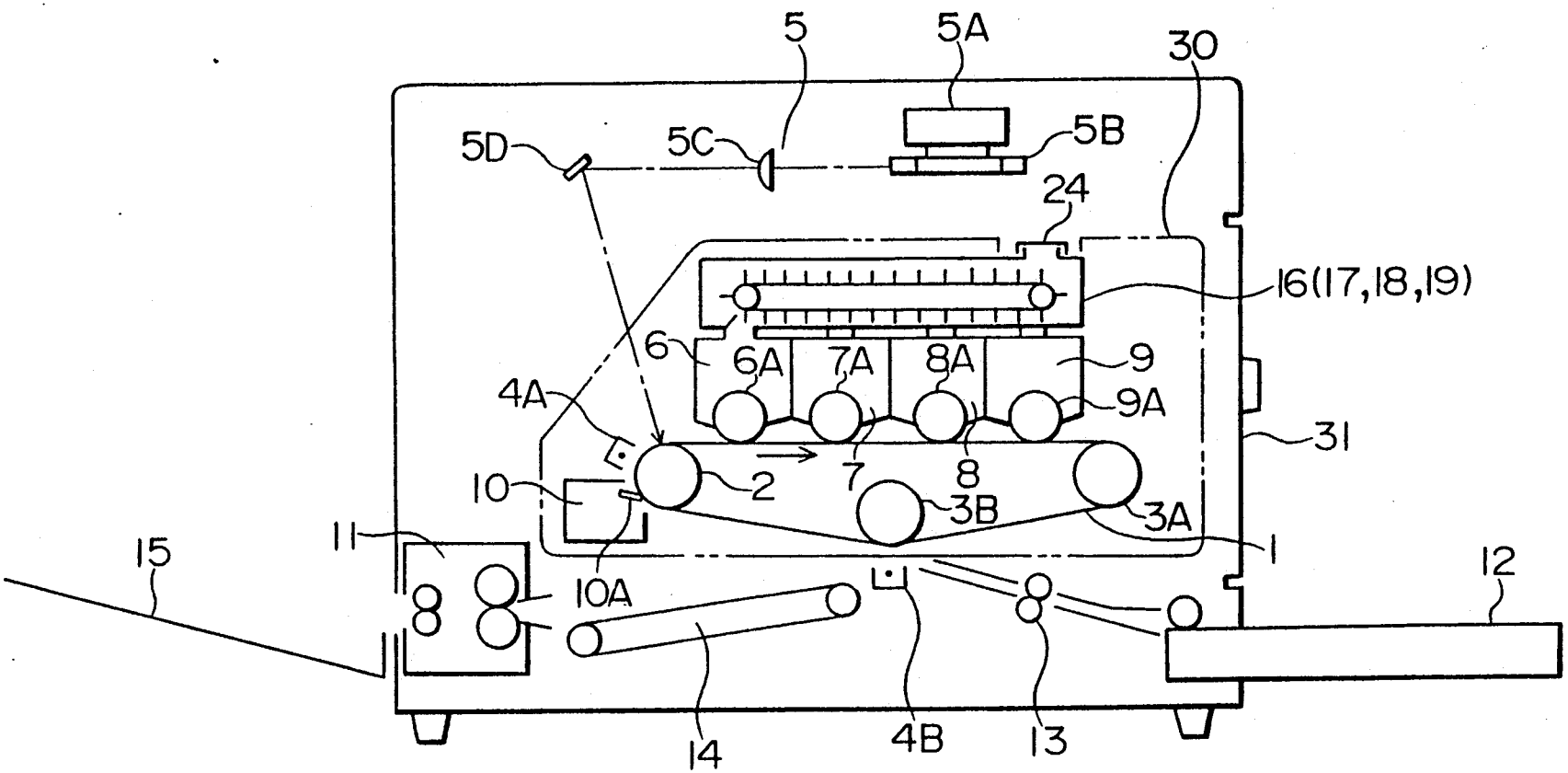
FIG. 13 is a schematic illustration showing the structure of the third example of the second embodiment.
Figure 14:
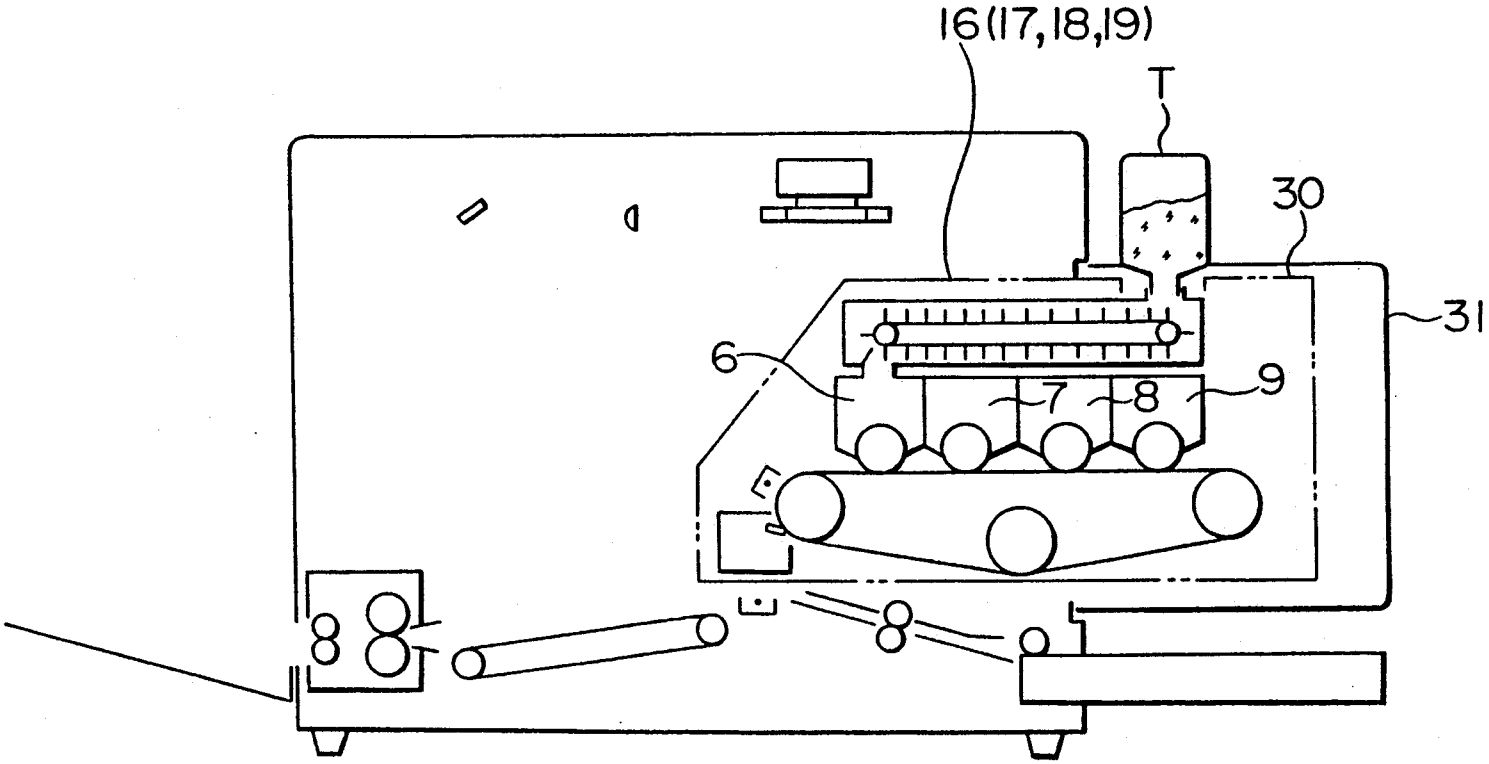
FIG. 14 is a schematic illustration showing a state in which the cartridge of the aforementioned apparatus is moved.

FIGS. 13 and 14 show the third example of the second embodiment of the image forming apparatus of the present invention. This example is different from other examples in that the charger 4A and the transfer unit 4B are separated from each other.

Figure 16A:
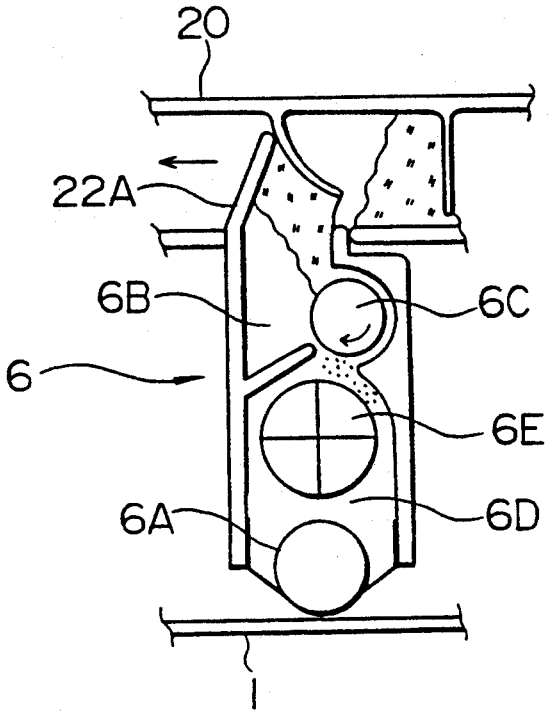
FIGS. 16A and 16B are sectional views showing the developing unit used for the aforementioned apparatus.

In the case where two-component developer is used in the first, second and third examples, the developing unit shown in FIG. 16A is applied. In the developing unit, toner is supplied by the conveyance member 20, and temporarily stored in the toner reservoir 6B. After that, when the toner supply roller 6C is rotated in accordance with the decrease in the concentration of toner in the developer tank 6D, toner is conveyed into the developer tank 6D. Then, the toner is uniformly mixed with carrier by the action of the stirring member 6E, and after that, the toner is supplied to the developing sleeve 6A.

Figure 16B:
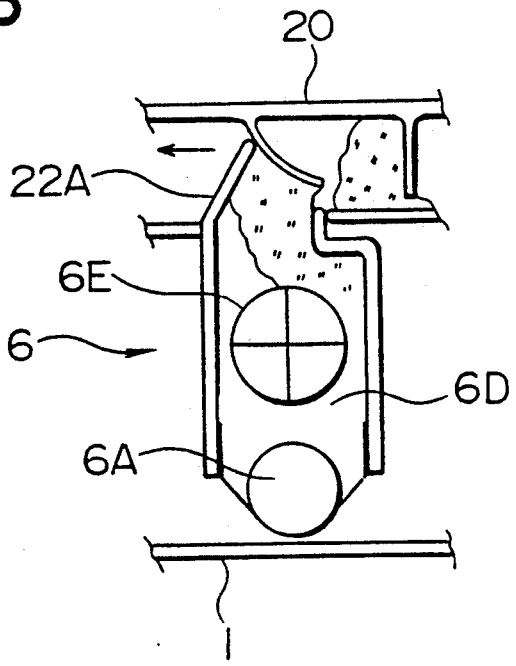

On the other hand, in the case where one-component developer is used, the developing unit shown in FIG. 16B is applied. The toner conveyed by the conveyance member 20 is directly conveyed into the developing tank 6D in accordance with the consumed amount, and then the toner is stirred by the stirring member 6E so that the toner can be uniformly distributed. After that, the toner is supplied to the developing sleeve 6A.

Figure 17:
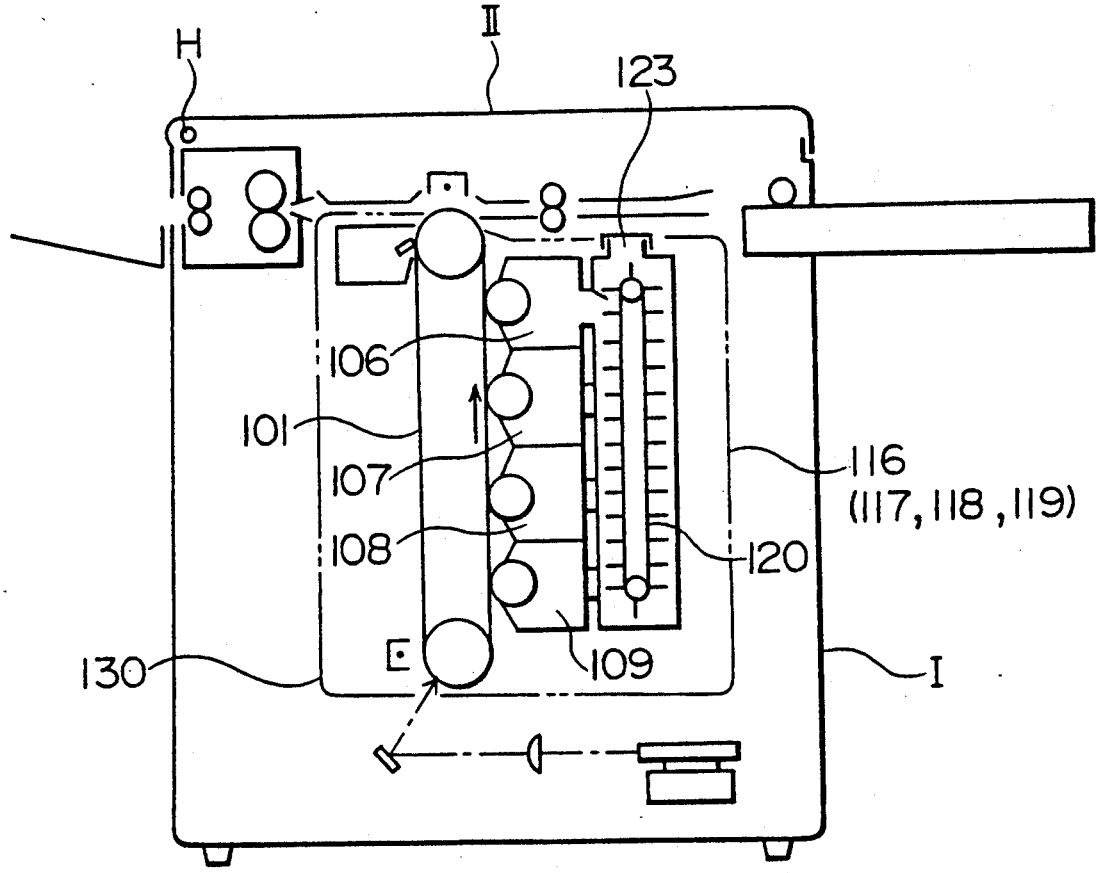
FIG. 17 is a schematic illustration showing the structure of the third embodiment of the color image forming apparatus.

FIG. 17 is a schematic illustration showing the third embodiment in which a plurality of developing units are disposed on the side of the belt-shaped image forming body.

In this case, the developing units 106, 107, 108 and 109 are disposed in parallel with respect to the circumferential surface of the photoreceptor belt 101 provided vertically. Therefore, each of the toner containers 116, 117, 118 and 119 makes a right angle with each of the developing units, and is disposed vertically in parallel.

Figure 18:
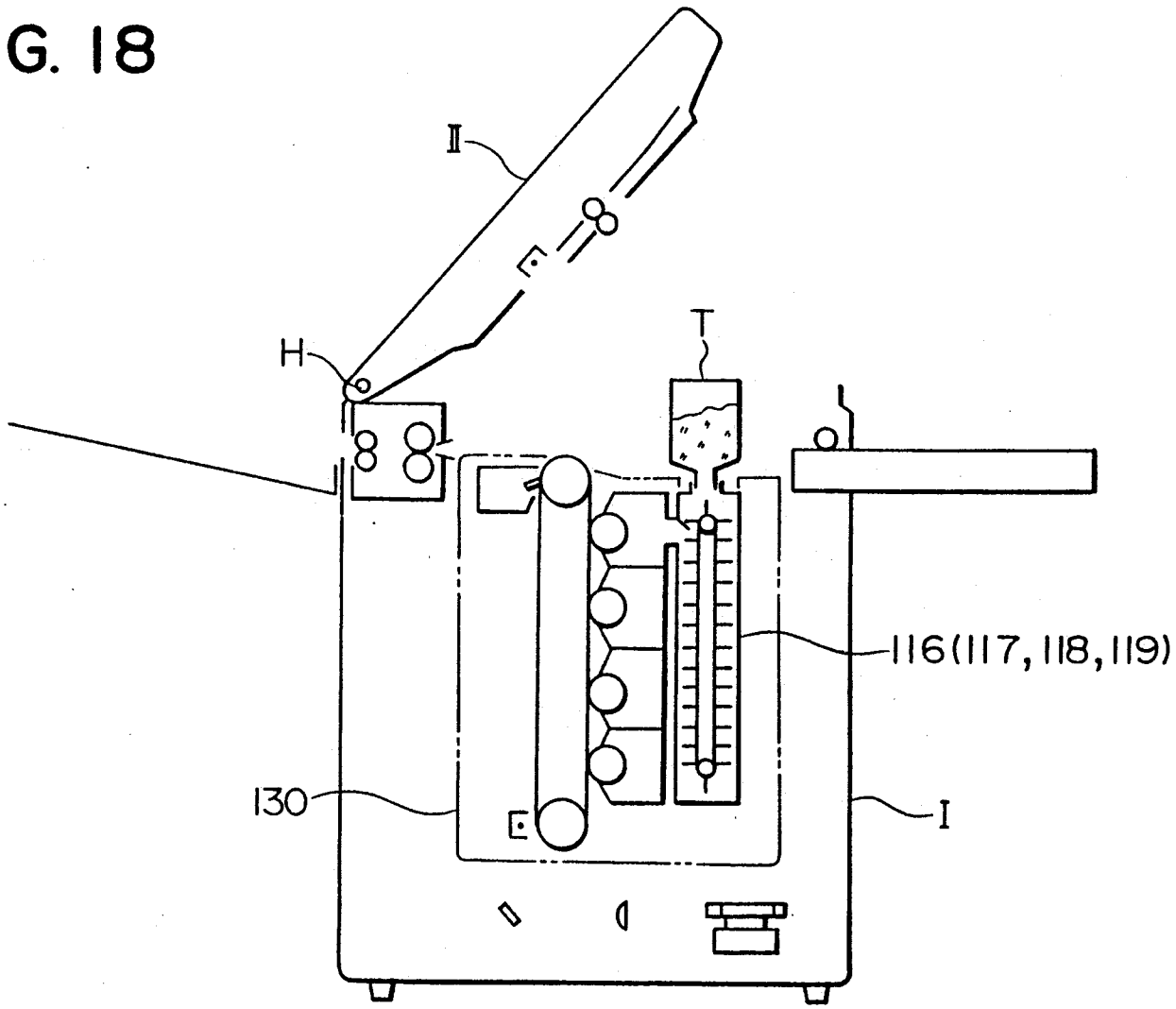
FIG. 18 is a schematic illustration showing a state in which the upper body of the aforementioned apparatus is open.

Therefore, the toner supply ports 123 can be disposed in series on the upper surface of the process cartridge 130. Accordingly, when the apparatus body is composed of two parts, one is a lower part I and the other is an upper part II, and when the upper part II is rotated around hinge H so as to be opened as shown in FIG. 18, toner cartridges T can be provided to the toner containers without moving the process cartridge 30.

Figure 19A:
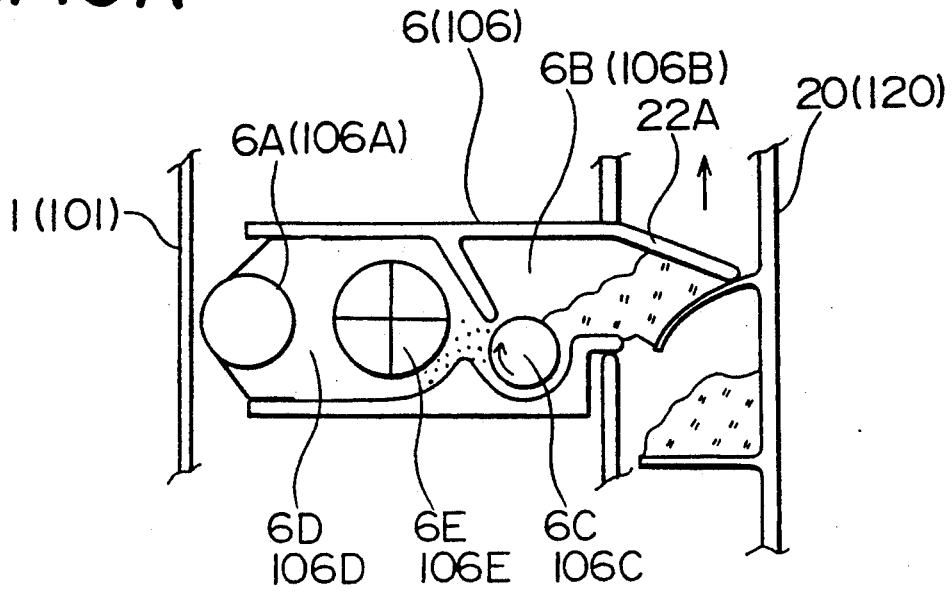
FIGS. 19A and 19B are sectional views of the developing unit used for the aforementioned apparatus.
Figure 19B:
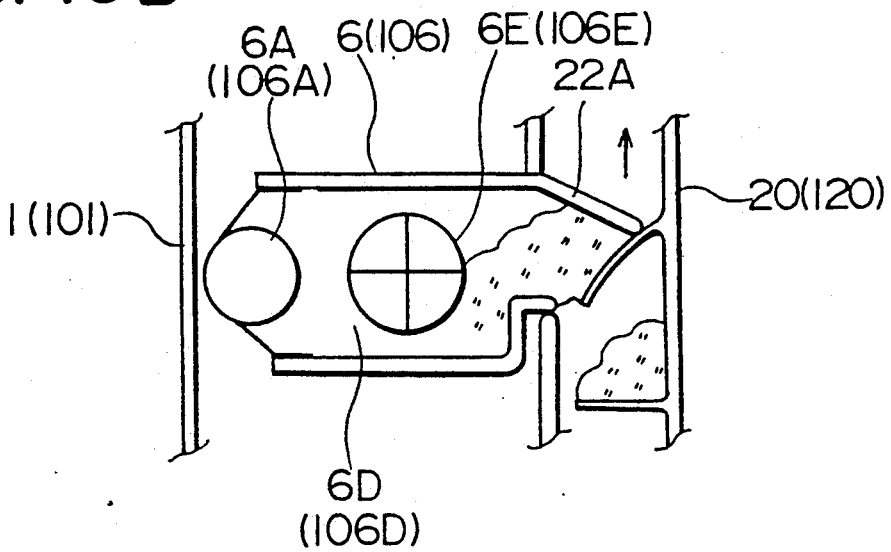

In the case of the developing units that are vertically disposed as shown in FIGS. 19A and 19B, toner is supplied to each developing unit in the following manner: the conveyance member 20 is rotated clockwise; and the toner scooped by the fin 20A is contacted with the sliding plate 22A so that the toner can be removed from the surface of the fin 20A.

According to the present invention, a color image forming apparatus can be provided that is characterized in that: toner can be replenished to the toner containers mounted on the process cartridge while the process cartridge is installed in the apparatus body; as a result, toner can be replenished very easily; and even when the process cartridge is attached to and detached from the apparatus, toner leakage is not caused.

The first object can be accomplished by the first and second embodiments that have been described before. Further, another examples to accomplish the first object will be explained here.

Figure 20A:
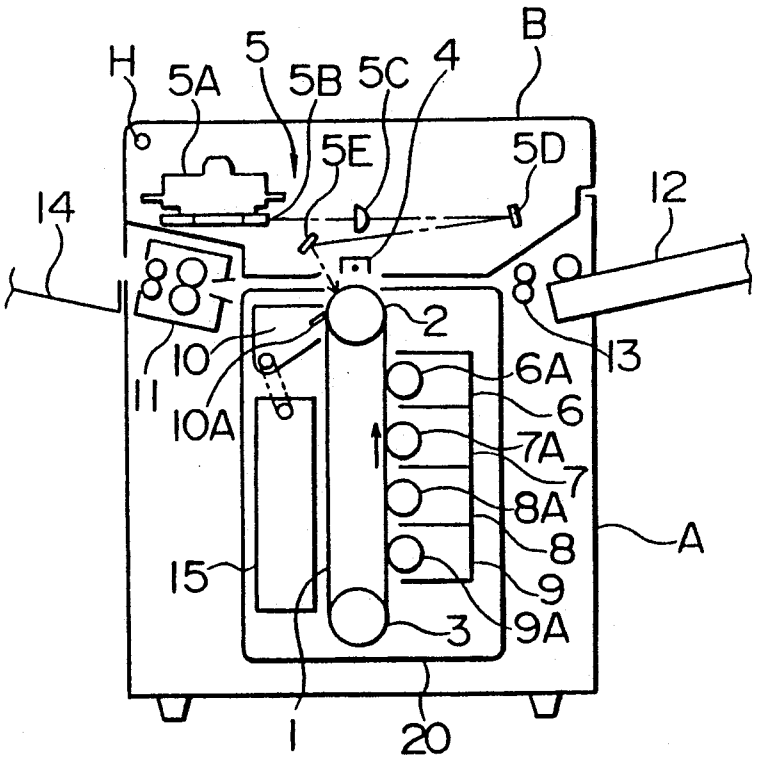
FIGS. 20A, 20B, 21A, 21B, 22A, 22B, 23A, and 23B are schematic illustrations of the other examples of the color image forming apparatus to accomplish the first object of the present invention.

FIG. 20A is a schematic illustration showing another example to accomplish the first object. In the drawing, numeral 1 is a flexible photoreceptor belt that is a belt-shaped image forming body. The photoreceptor belt 1 vertically provided between rotational rollers 2 and 3, and rotated counterclockwise in the arrowed direction when the rotational roller 2 is driven.

Numeral 4 is a transfer unit that is also used as a charging means. In this example, the transfer unit 4 is disposed in the upper portion of a process cartridge that will be described later. Numeral 5 is a laser writing system unit that is an exposure means. Numerals 6 to 9 are developing units respectively containing toner of a specific color. Numeral 10 is a cleaning unit. Numeral 11 is a fixing unit.

The process cartridge 20 integrates the photoreceptor belt 1, developing units 6, 7, 8, 9, cleaning unit 10, and waste toner box 15 accommodating toner collected by the cleaning unit 10. The integrated cartridge 20 is attached to and detached from the color image forming apparatus.

The color image forming apparatus is composed of lower body A accommodating the process cartridge 20, and upper body B accommodating the transfer unit 4 and laser writing system unit 5. In the color image forming apparatus, a transfer sheet feeding passage is formed by the bottom surface of upper body B, and the upper surface of the process cartridge 20 provided in lower body A. Upper body B is rotated counterclockwise around hinge H so that it can be opened and held in the state shown in FIG. 20B.

As described above, when upper body B is open, the transfer sheet feeding passage can be widely opened. As a result, a jammed transfer sheet can be easily removed from the passage, and the process cartridge can be easily attached to and detached from the apparatus.

Even when toner is leaking from the developing unit or the cleaning unit 10 in the case where the process cartridge 20 is attached to or detached from the apparatus, the transfer unit 4 and the laser writing system unit 5 have already been withdrawn to the upper side portions, so that there is no possibility that they are stained with toner. Therefore, the performance of charging, transfer and exposure can be always maintained in a normal condition.

Figure 20B:
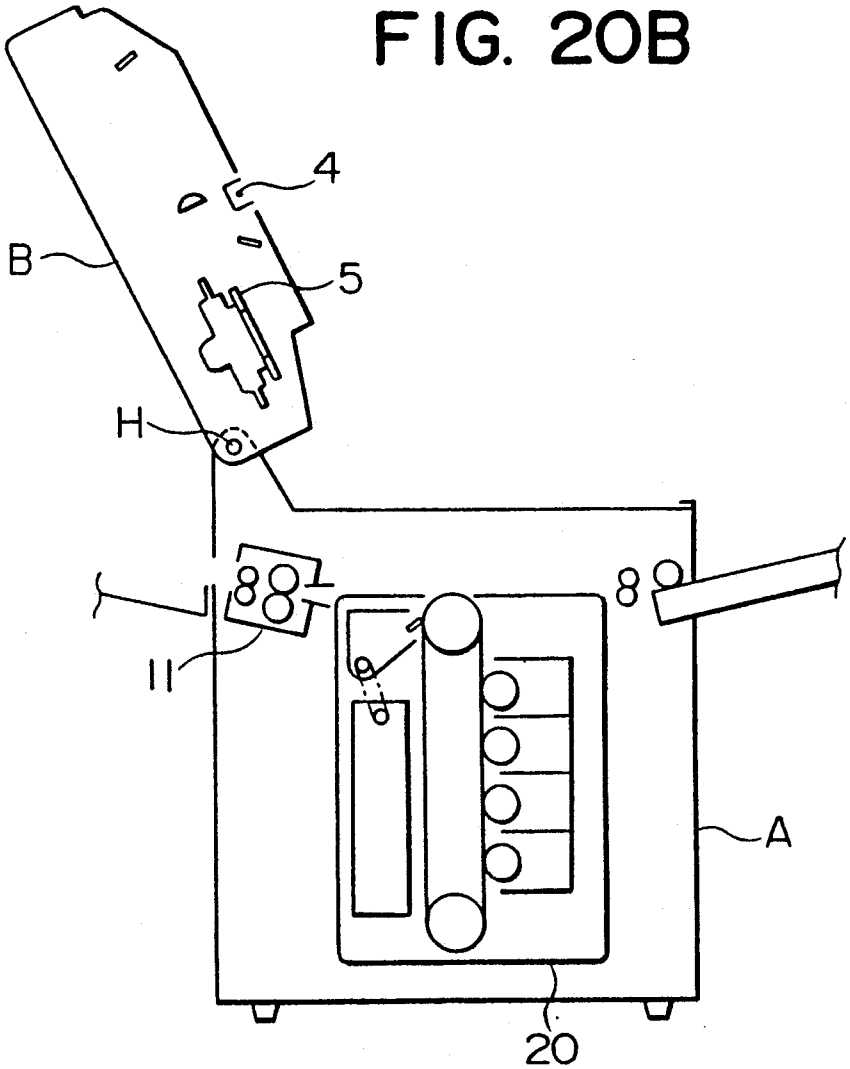
Figure 21A:
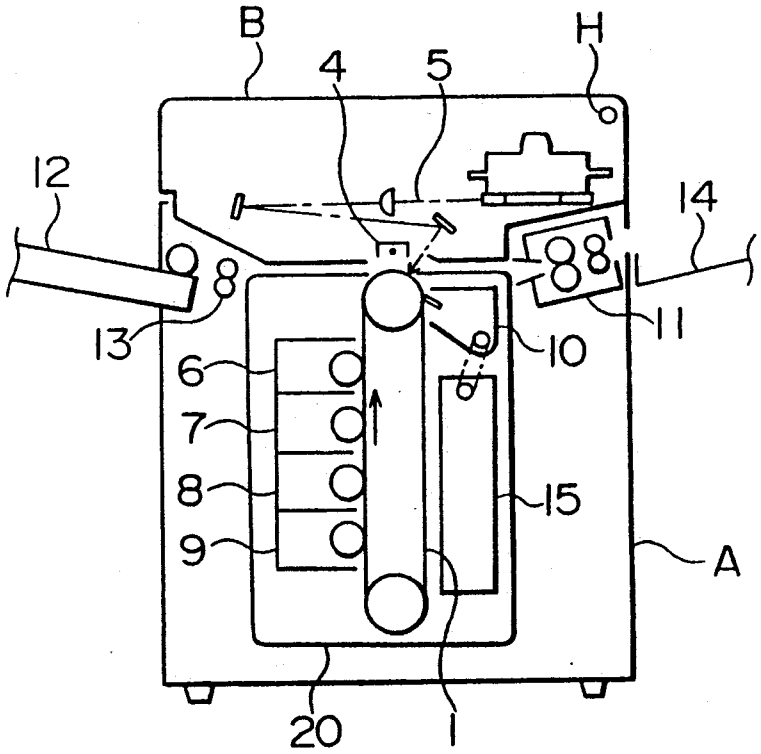
Figure 21B:
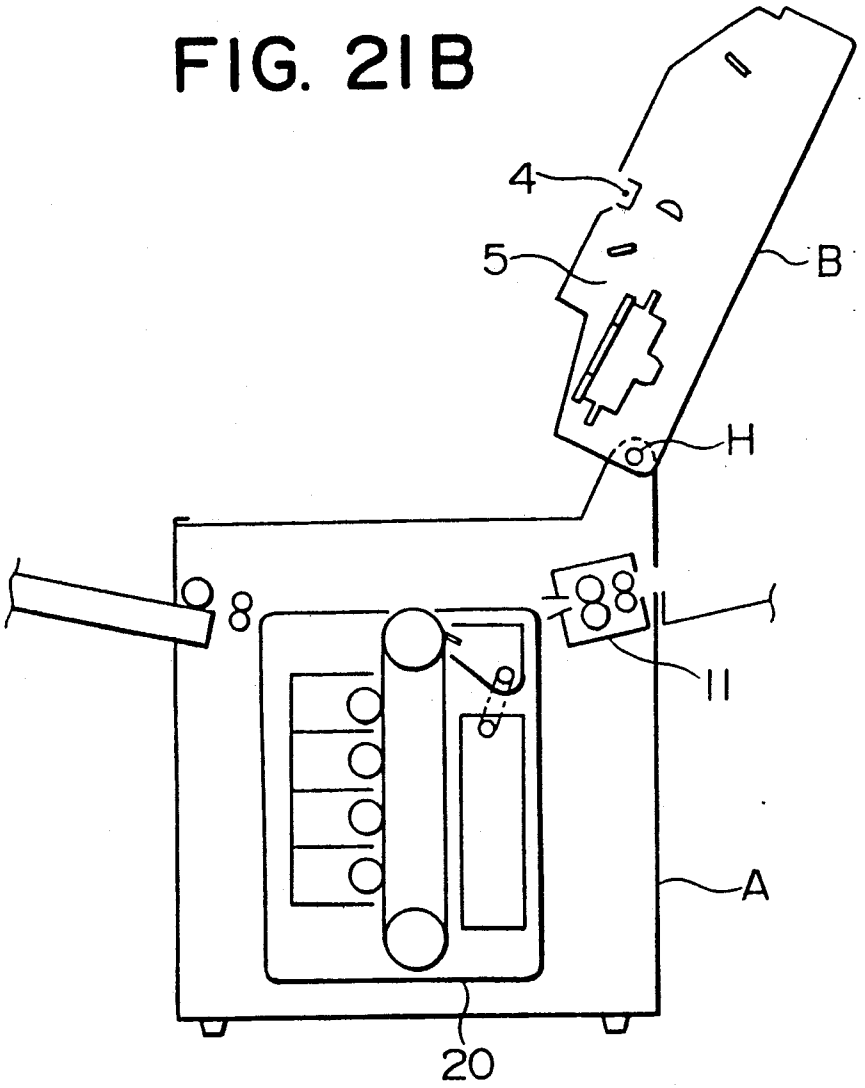

FIGS. 21A and 21B are schematic illustrations of a color image forming apparatus, the units of which are symmetrically disposed with respect to the color image forming apparatus shown in FIGS. 20A and 20B. In this case, the photoreceptor belt 1 is driven clockwise, and upper body B is rotated clockwise around hinge H so as to be opened.

Figure 22A:
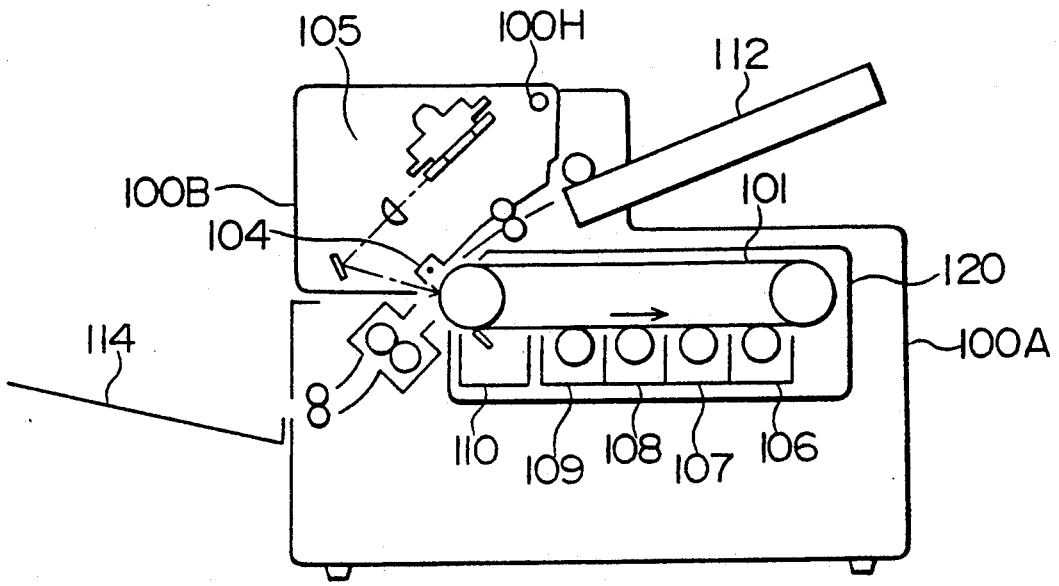

FIG. 22A is a schematic illustration of a color image forming apparatus having the horizontal photoreceptor belt 101 to which the present invention is applied. Upper body 100B is rotated clockwise around the hinge 100H so as to be open. On the other hand, the process cartridge 120 can be horizontally attached to or detached from the apparatus when the side surface on the viewer's side of lower body 100A is open. Of course, it is possible to detach the process cartridge 120 from the apparatus to the right when the right side surface of the lower body 100A is open.

Figure 22B:
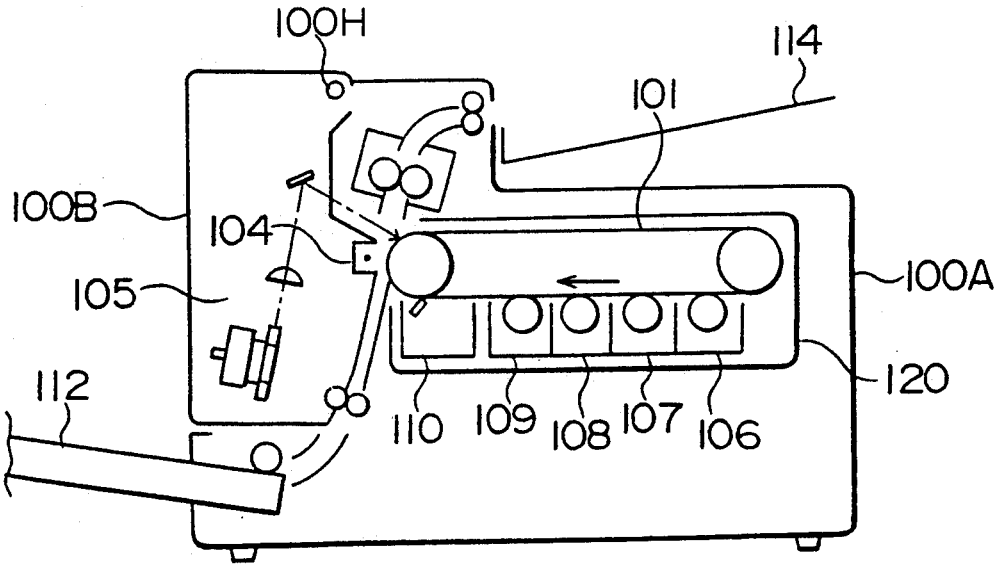

FIG. 22B is a schematic illustration of a color image forming apparatus in which the transfer sheet feeding passage of the color image forming apparatus shown in FIG. 22A is reversed. In this case, when upper body 100B is open, the process cartridge 120 can be horizontally detached from lower body 100A to the left.

Figure 23A:
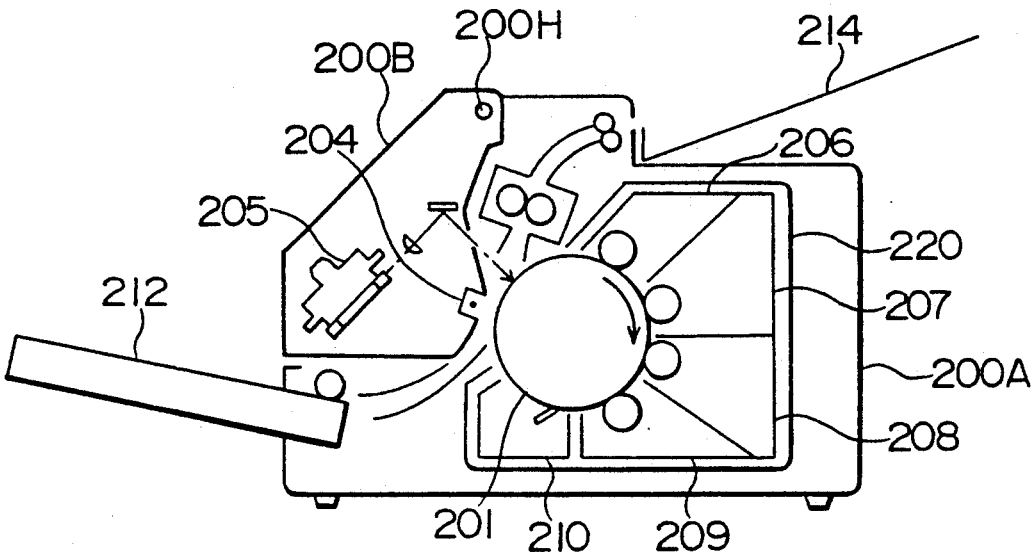
Figure 23B:
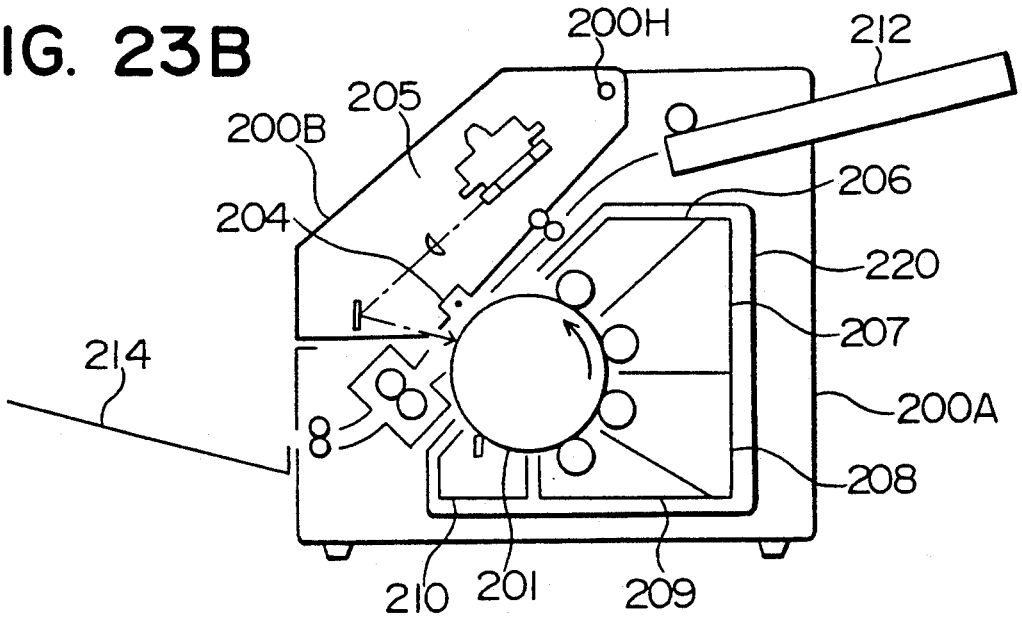

FIG. 23A is a schematic illustration showing a color image forming apparatus in which the photoreceptor drum 201, which is a drum-shaped image forming body, is utilized. Upper body 200B is rotated clockwise around hinge 200H so as to be open, and the process cartridge 220 can be horizontally detached from the apparatus when the side surface of lower body 200A of the viewer's side is open. FIG. 23B is a schematic illustration showing a color image forming apparatus in which the transfer sheet feeding direction is opposite to that of the color image forming apparatus shown in FIG. 23A.

According to the present invention, jam clearance and maintenance of process units can be easily carried out. Further, in the process of jam clearance or maintenance, the electrode of charging and transfer, and the optical members can be prevented from being stained with toner.

What is claimed is:

1. An apparatus for forming a color toner image comprising:

a photoreceptor on which a color toner image is formed;

a charging device for charging said photoreceptor to a given electric potential;

an exposure device for exposing said charged photoreceptor with an image light to form a latent image;

a plurality of developing devices for developing said latent image to form a toner image;

a transfer device for transferring said toner image onto a transfer sheet;

a sheet passage at one side of which said photoreceptor is disposed so that said transfer sheet is conveyed through said sheet passage and is brought into contact with said photoreceptor on said transfer device; and said exposure device disposed at the other side of said sheet passage so that said image light irradiated from said exposure device crosses said sheet passage and proceeds to said photoreceptor, said charging device being disposed on said transfer device and used as a transfer electrode to transfer said toner image from said photoreceptor to said transfer sheet.

2. An apparatus for forming a color toner image comprising:

a photoreceptor on which a color toner image is formed;

a charging device for charging said photoreceptor to a given electric potential; p1 an exposure device for exposing said charged photoreceptor with an image light to form a latent image;

a plurality of developing devices for developing said latent image to form a toner image;

a transfer device for transferring said toner image onto a transfer sheet;

a sheet passage at one side of which said photoreceptor is disposed so that said transfer sheet is conveyed through said sheet passage and is brought into contact with said photoreceptor on said transfer device; and said exposure device disposed at the other side of said sheet passage so that said image light irradiated from said exposure device crosses said sheet passage and proceeds to said photoreceptor, said photoreceptor is a belt type photoreceptor wherein an endless photoreceptor belt is looped around at least two rollers arranged horizontally whereby said photoreceptor belt has a horizontal portion between said rollers and a side portion around said rollers, and wherein said transfer device is disposed on said side portion.

3. The apparatus of claim 2 wherein said plurality of developing devices differ in colors and are disposed on said horizontal portion of said photoreceptor belt.

4. The apparatus of claim 2 wherein said plurality of developing devices differs in colors and is disposed under or above said horizontal portion of said photoreceptor belt.

5. An apparatus for forming a color toner image comprising:

a photoreceptor on which a color toner image is formed;

a charging device for charging said photoreceptor to a given electric potential;

an exposure device for exposing said charged photoreceptor with an image light to form a latent image;

a plurality of developing devices for developing said latent image to form a toner image;

a transfer device for transferring said toner image onto a transfer sheet;

a sheet passage at one side of which said photoreceptor is disposed so that said transfer sheet is conveyed through said sheet passage and is brought into contact with said photoreceptor on said transfer device;

said exposure device disposed on the other side of said sheet passage so that said image light irradiated from said exposure device crossed said sheet passage and proceeds to said photoreceptor; and a cartridge in which said photoreceptor and said developing devices are incorporated, said cartridge adapted to be detachably mounted on the other side of said exposure device in said apparatus.

6. The apparatus of claim 5 wherein said charging device is disposed on said transfer device and used as a transfer electrode to transfer said toner image from said photoreceptor to said transfer sheet.

7. The apparatus of claim 5 further comprising a plurality of toner containers.

8. The apparatus of claim 7 wherein said plurality of developing devices is arranged in parallel in transverse direction relative to said photoreceptor belt and said plurality of toner containers is also arranged in parallel in said transverse direction.

9. The apparatus of claim 8 wherein said plurality of developing devices is disposed under said horizontal portion and said plurality of toner containers are disposed on said horizontal portion.

10. The apparatus of claim 8 wherein said plurality of developing devices is disposed on said horizontal portion and said plurality of toner containers are mounted on said plurality of developing devices.

11. The apparatus of claim 7 wherein said plurality of developing devices is arranged in parallel in a transverse direction relative to said photoreceptor belt and said plurality of toner containers is arranged in parallel in a longitudinal direction relative to said photoreceptor belt.

12. The apparatus of claim 11 wherein said plurality of developing devices is disposed under said horizontal portion sand said plurality of toner containers is disposed on said horizontal portion.

13. An apparatus for forming a color toner image comprising:

a photoreceptor on which a color toner image is formed;

a charging device for charging said photoreceptor to a given electric potential;

exposure device for exposing said charged photoreceptor with an image light to form a latent image;

a plurality of developing devices for developing said latent image to form a toner image;

a transfer device for transferring said toner image onto a transfer sheet;

a sheet passage at one side of which said photoreceptor is disposed so that said transfer sheet is conveyed through said sheet passage and is brought into contact with said photoreceptor on said transfer device;

said exposure device disposed at the other side of said sheet passage so that said image light irradiated from said exposure device crosses said sheet passage and proceeds to said photoreceptor, and a mover for moving said exposure device so that said sheet passage is opened.

14. The apparatus of claim 13 wherein said charging device is disposed on said transfer device and used as a transfer electrode to transfer said toner image from said photoreceptor to said transfer sheet.

15. The apparatus of claim 13 further comprising a cartridge in which said photoreceptor and said developing devices are incorporated, said cartridge being detachably mounted on the other side of said exposure device in said apparatus.

16. An apparatus for forming a color toner image comprising a photoreceptor on which a color toner image is formed;

a charging device for charging said photoreceptor to a given electric potential;

an exposure device for exposing said charged photoreceptor with an image light to form a latent image;

a plurality of developing devices for developing said latent image to form a toner image;

a transfer device for transferring said toner image onto a transfer sheet;

a cleaning device for cleaning residual toner particles on said photoreceptor after said toner image has been transferred;

a sheet passage on one side of which said photoreceptor is disposed so that said transfer sheet is conveyed through said sheet passage and is brought into contact with said photoreceptor adjacent said transfer device, wherein said plurality of developing devices and said cleaning device are disposed on the same side of said sheet passage as said photoreceptor; and said exposure device and said transfer device are disposed on the other side of said sheet passage so that said image light irradiated from said exposure device crosses said sheet passage and strikes and exposes said photoreceptor adjacent said transfer device.

17. The apparatus of claim 16 wherein said photoreceptor and said developing devices are incorporated in a cartridge which is detachably mounted in said apparatus.

* * * * *